US009080470B2

(12) United States Patent
Wigsten

(10) Patent No.: US 9,080,470 B2
(45) Date of Patent: Jul. 14, 2015

(54) SHARED OIL PASSAGES AND/OR CONTROL VALVE FOR ONE OR MORE CAM PHASERS

(71) Applicant: Mark M. Wigsten, Lansing, NY (US)

(72) Inventor: Mark M. Wigsten, Lansing, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 14/349,455

(22) PCT Filed: Oct. 9, 2012

(86) PCT No.: PCT/US2012/059300
§ 371 (c)(1),
(2) Date: Apr. 3, 2014

(87) PCT Pub. No.: WO2013/055658
PCT Pub. Date: Apr. 18, 2013

(65) Prior Publication Data

US 2014/0261266 A1 Sep. 18, 2014

Related U.S. Application Data

(60) Provisional application No. 61/547,390, filed on Oct. 14, 2011.

(51) Int. Cl.

| | |
|---|---|
| ***F01L 1/34*** | (2006.01) |
| ***F01L 1/344*** | (2006.01) |
| ***F01M 9/10*** | (2006.01) |
| ***F01M 1/16*** | (2006.01) |

(52) U.S. Cl.
CPC ..... *F01L 1/344* (2013.01); *F01L 1/3442* (2013.01); *F01M 1/16* (2013.01); *F01M 9/10* (2013.01); *F01L 2001/34426* (2013.01)

(58) Field of Classification Search
CPC ..... F01L 1/344; F01L 1/3442; F01L 2001/34426; F01M 1/16; F01M 9/10
USPC ..... 123/90.15, 90.17; 464/160
See application file for complete search history.

(56) References Cited

U.S. PATENT DOCUMENTS

| | | | |
|---|---|---|---|
| 5,170,755 | A | 12/1992 | Kano et al. |
| 5,243,935 | A | 9/1993 | Kano et al. |
| 5,271,360 | A | 12/1993 | Kano et al. |
| 5,341,777 | A | 8/1994 | Miura et al. |
| 6,053,138 | A | 4/2000 | Trzmiel et al. |
| 6,250,265 | B1 | 6/2001 | Simpson |
| 6,382,155 | B2 | 5/2002 | Simpson |

(Continued)

*Primary Examiner* — Ching Chang
(74) *Attorney, Agent, or Firm* — Helmholdt Law PLC; Thomas D. Helmholdt

(57) ABSTRACT

A variable cam timing phaser (10) can a drive stator (14) and at least one driven rotor (20, 20*a*, 20*b*) mounted for rotation about a common axis. At least one vane-type hydraulic coupling can define at least one expandable fluid chamber (40, 50, 40*a*, 50*a*, 40*b*, 50*b*) for coupling the at least one driven rotor (20, 20*a*, 20*b*) for rotation with the drive stator (14) to enable the phase of the at least one driven rotor (20, 20*a*, 20*b*) to be adjusted independently of one another and independently relative to the drive stator (14). A control valve (60) can have at least one inlet port (62), at least one outlet port (64, 64*a*), and at least one common shared fluid passage (16, 16*a*, 16*b*, 16*c*, 16*d*). At least one rotatable fluid flow diverter (80, 80*a*) can be in fluid communication with the at least one common shared fluid passage (16, 16*a*, 16*b*, 16*c*, 16*d*) for selectively communicating the at least one common shared fluid passage (16, 16*a*, 16*b*, 16*c*, 16*d*) with the at least one expandable fluid chamber (40, 50, 40*a*, 50*a*, 40*b*, 50*b*).

13 Claims, 8 Drawing Sheets

(56) References Cited

U.S. PATENT DOCUMENTS

| | | | | |
|---|---|---|---|---|
| 6,477,999 | B1 | 11/2002 | Markley | |
| 6,481,402 | B1 | 11/2002 | Simpson et al. | |
| 6,725,817 | B2 * | 4/2004 | Methley et al. | 123/90.17 |
| 6,745,121 | B2 * | 6/2004 | Watanuki et al. | 701/114 |
| 6,978,746 | B2 | 12/2005 | Kibler | |
| 7,231,896 | B2 | 6/2007 | Mott et al. | |
| 7,444,968 | B2 | 11/2008 | Lancefield et al. | |
| 7,581,519 | B2 | 9/2009 | Hayase et al. | |
| 8,584,637 | B2 | 11/2013 | Scheidig | |
| 8,584,638 | B2 | 11/2013 | Scheidig | |
| 2007/0215084 | A1 | 9/2007 | Pluta et al. | |
| 2008/0135004 | A1 | 6/2008 | Simpson et al. | |
| 2009/0107433 | A1 | 4/2009 | Tanaka | |
| 2014/0116365 | A1 | 5/2014 | Scheidig | |

* cited by examiner

SHARED OIL PASSAGES AND/OR CONTROL VALVE FOR ONE OR MORE CAM PHASERS

FIELD OF THE INVENTION

The invention relates to a mechanism intermediate a crankshaft and a poppet-type intake or exhaust valve of an internal combustion engine for operating at least one such valve, wherein the mechanism varies the time period relative to the operating cycle of the engine, and more particularly, wherein the mechanism operably engages with a camshaft to vary an angular position of one camshaft and an associated cam relative to another camshaft and associated cam.

BACKGROUND

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. A crankshaft can take power from the pistons to drive at least one transmission and at least one camshaft. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

As is conventional in the art, there can be one or more camshafts per engine. A camshaft can be driven by a belt, or a chain, or one or more gears, or another camshaft. One or more lobes can exist on a camshaft to push on one or more valves. A multiple camshaft engine typically has one camshaft for exhaust valves, one camshaft for intake valves. A "V" type engine usually has two camshafts (one for each bank) or four camshafts (intake and exhaust for each bank).

Variable cam timing (VCT) devices are generally known in the art, such as U.S. Pat. No. 7,841,311; U.S. Pat. No. 7,789,054; U.S. Pat. No. 7,270,096; U.S. Pat. No. 6,725,817; U.S. Pat. No. 6,244,230; and U.S. Published Application No. 2010/0050967. Known patents and publications disclose hydraulic couplings for phaser assemblies in which an annular space is provided between a drive stator member concentrically surrounding one or more driven rotor members. An annular space between the members can be divided into segment-shaped or arcuate variable volume working chambers by one or more vanes extending radially inward from an inner surface of the drive stator member and one or more vanes extending radially outward from an outer surface of the one or more driven rotor members. As hydraulic fluid is admitted into and expelled from the various chambers, the vanes rotate relative to one another and thereby vary the relative angular position of the drive stator member and the one or more driven rotor members. Hydraulic couplings that use radial vanes to apply a tangentially acting force will be referred to herein as vane-type hydraulic couplings. Each of these prior known patents and publications appears to be suitable for its intended purpose. However, it would be desirable to provide a variable cam timing phaser with a simplified fluid flow passage configuration. It would be desirable to provide a variable cam timing phaser having common shared fluid passage portions. It would be desirable to provide a variable cam timing phaser having a shared control valve for one or more phase shifting driven rotors.

SUMMARY

A variable cam timing phaser can be driven by power transferred from an engine crankshaft and delivered to a camshaft for manipulating at least one set of cams. The phaser can include a drive stator connectable for rotation with an engine crankshaft through an endless loop power transmission member and at least one driven rotor. The at least one driven rotor can be connected for rotation with a corresponding camshaft supporting at least one set of cams.

The variable cam timing phaser can include a drive stator and at least one driven rotor all mounted for rotation about a common axis. At least one vane-type hydraulic coupling can define at least one expandable fluid chamber for coupling the at least one driven rotor for rotation with the drive stator to enable the phase of the at least one driven rotor to be adjusted independently relative to the drive stator. A control valve can include an inlet port, an outlet port, and at least one common shared fluid passage. A rotatable fluid flow diverter can be in fluid communication with the at least one common shared fluid passage for selectively communicating the at least one common shared fluid passage with the at least one expandable fluid chamber.

The rotatable fluid flow diverter can include at least one annular groove segment extending around a portion of a circumference of a shaft or bearing, while the other of the bearing or shaft includes at least one fluid communication port. A corresponding one of the at least one expandable fluid chambers is in fluid communication through a fluid flow connection established between the at least one annular groove segment and the at least one fluid communication port. The shaft is rotated to bring a carried portion of the rotatable fluid flow diverter into fluid communication with a stationary portion of the fluid flow diverter for selectively communicating the at least one common shared fluid passage with the corresponding one of the at least one expandable fluid chambers during a repetitive angular portion of each rotation of the shaft.

A method for assembling a variable cam timing phaser can include mounting at least one driven rotor with respect to a drive stator for rotation about a common rotational axis, and coupling the at least one driven rotor for rotation to the drive stator with at least one vane-type hydraulic coupling defining at least one expandable fluid chamber to enable the phase of the at least one driven rotor to be adjusted independently relative to the drive stator. A control valve can be provided having an inlet port, an outlet port, and at least one common shared fluid passage. At least one annular groove segment is formed extending around an angular portion of at least one circumference of the at least one shaft or at least one bearing, while the other of the at least one bearing or at least one shaft includes at least one fluid communication port. A corresponding one of the at least one expandable fluid chamber is in fluid communication through a fluid flow connection established between the at least one annular groove segment and the at least one fluid communication port to define a rotatable fluid flow diverter for selectively communicating the at least one common shared fluid passage with the at least one expandable fluid chamber during each repetitive angular portion of rotation of the at least one shaft.

A pressurized fluid control system can include at least two members defining at least one expandable fluid chamber therebetween and movable with respect to one another in response to fluid flow into and out of the at least one expandable fluid chamber. A control valve can have at least one inlet port, at least one outlet port, and at least one common shared fluid passage. At least one rotatable fluid flow diverter can be in fluid communication with the at least one common shared fluid passage for selectively communicating the at least one common shared fluid passage with the at least one expandable fluid chamber. The at least one fluid flow diverter can include at least one annular groove segment extending around a portion of a circumference of one of a shaft and a bearing, while an other of the bearing and the shaft includes a fluid communication port. A corresponding one of the at least one expandable fluid chambers is in fluid communication through a fluid flow connection established between the at least one annular groove segment and the at least one fluid communication port. The shaft is rotated to bring the at least one annular groove segment and fluid communication port into fluid communication with one another for selectively communicating the at least one common shared fluid passage with the corresponding one of the at least one expandable fluid chambers during a repetitive angular portion of each rotation.

A method is disclosed for controlling a pressurized fluid control system having at least two members defining at least one expandable fluid chamber therebetween and movable with respect to one another in response to fluid flow into and out of the at least one expandable fluid chamber. A spool of a control valve can be driven between at least two positions selected from positions located between a full travel position and a zero travel position. The control valve can have at least one inlet port, at least one outlet port, and at least one common shared fluid passage. At least one rotatable fluid flow diverter can have at least one annular groove segment extending around a portion of at least one circumference of at least one shaft and at least one bearing, while an other of the at least one bearing and at least one shaft includes a fluid communication port. A corresponding one of the at least one expandable fluid chamber is in fluid communication through a fluid flow connection established between the at least one annular groove segment and the at least one fluid communication port. The shaft can be rotated to bring the at least one annular groove segment and at least one fluid communication port into fluid communication with one another for selectively communicating the at least one common shared fluid passage with the at least one expandable fluid chamber during a repetitive angular portion of each rotation.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 7A:
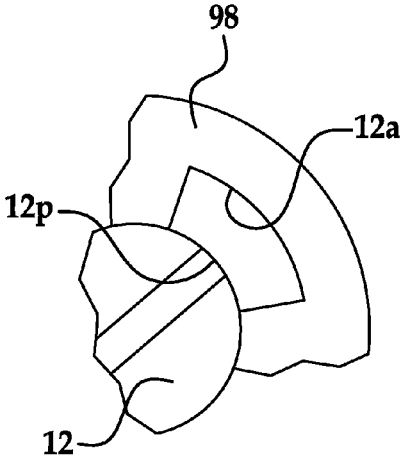
FIG. 7A is a detailed view of an alternative configuration where at least one annular groove segment is formed extending around a portion of a circumference of a bearing, while the shaft includes at least one fluid communication port, wherein the at least one expandable fluid chambers is in fluid communication through a fluid flow connection established between the at least one annular groove segment and the at least one fluid communication port during repetitive angular portions of rotation of the shaft.
Figure 7:
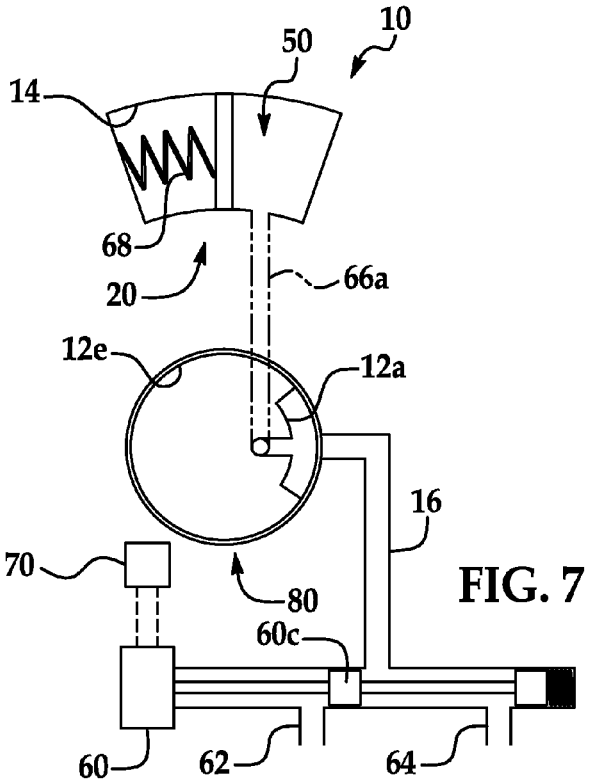
FIG. 7 is a simplified schematic of a variable cam timing phaser having a drive stator, a driven rotor, a control valve, a common shared fluid passage and a rotatable fluid flow diverter in a first angular position of rotation.

Referring now to FIG. 7, a simplified schematic illustrates a variable cam timing phaser 10 having a drive stator 14, a driven rotor 20, a control valve 60, a common shared fluid passage 16, and a rotatable fluid flow diverter 80 in a first angular position of rotation. The drive stator 14 and driven rotor 20 can be mounted for rotation about a common axis. At least one vane-type hydraulic coupling defines at least one expandable fluid chamber 50 to couple the at least one driven rotor 20 for rotation with the drive stator 14 and to enable the phase of the at least one driven rotor 20 to be adjusted independently relative to the drive stator 14. In this configuration, the driven rotor 20 can be biased toward either an advanced-timing end limit of travel or a retard-timing end limit of travel by a mechanical spring 68. The control valve 60 can be operated in response to control signals 72 from an engine control unit 70. The control valve operates to selectively communicate an inlet port 62 in fluid communication with a supply passage for pressurized fluid, by way of example and not limitation, such as engine oil or hydraulic fluid, and an outlet port 64 in fluid communication with an exhaust passage for pressurized fluid with at least one common shared fluid passage 16. As illustrated in FIG. 7, the control valve 60 is shown shifted to the right from a null position placing the common shared fluid passage 16 in fluid communication with the outlet port 64 allowing the mechanical spring 68 to shift the driven rotor in a clockwise direction toward a predetermined end limit of travel. When the control valve 60 is shifted to the left past from the position illustrated past the null position, the common shared fluid passage 16 is placed in fluid communication with the inlet port 62 to pressurize the expandable fluid chamber 50 against the urging of the mechanical biasing spring 68 to drive the driven rotor 20 in counterclockwise rotation toward an opposite end limit of travel through a first fluid passage portion 66*a*, thereby providing a phase shift between the driving stator 14 and the driven rotor 20. The rotatable fluid flow diverter 80 is in fluid communication with the at least one common shared fluid passage 16 for selectively communicating the at least one common shared fluid passage 16 with the at least one expandable fluid chamber 50. By way of example and not limitation, the at least one expandable fluid chamber further can include an advance-timing expandable fluid chamber and/or a retard-timing expandable fluid chamber. The rotatable fluid flow diverter 80 can include a shaft 12, by way of example and not limitation such as a camshaft, having at least one annular groove segment 12*a* extending around a portion of a circumference of the shaft 12. The at least one groove segment 12*a* is in fluid communication with the common shared fluid passage 16 during an angular part of the rotation of the shaft 12 for selectively communicating the at least one common shared fluid passage 16 with the at least one expandable fluid chamber 50 as the shaft rotates. As the rotatable fluid flow diverter 80 rotates, the groove segment 12*a* is initially in fluid communication with the common shared fluid passage 16 until blocked by outer diameter land 12*e*. The expandable fluid chamber 50 is isolated from the common shared fluid passage 16 during another angular part of the rotation of the shaft 12, while outer diameter land 12*e* faces the common shared fluid passage 16 inlet. It should be recognized that the angular extent of the groove segment 12*a* and the angular extent of the outer diameter land 12*e* can be any desired non-overlapping angular degree of coverage. The common shared fluid passage 16 can be used as a single feed/vent passage to feed and/or vent at least one expandable fluid chamber 50 by pulsing the control pressure based on cam position.

Referring briefly to FIG. 7A, it should be recognized that any of the configurations described herein, either above or below, can be modified to include the at least one annular groove segment 12*a* extending around a portion of a circumference of at least one bearing 98, while the at least one shaft 12 includes a fluid communication port 12*p*. In other words, it should be recognized that it is disclosed herein to form the desired annular groove segment or segments 12*a* on a bearing 98, while forming the desired corresponding fluid communication port or ports 12*p* on the shaft 12 being supported by the bearing 98. This configuration also provides that the at least one expandable fluid chambers 50 can be placed in fluid communication through a fluid flow connection established between the at least one annular groove segment 12*a* and the at least one fluid communication port 12*p*. Rotation of the at least one shaft 12 brings the at least one annular groove segment 12*a* and the at least one fluid communication port 12*p* into fluid communication with one another during a repetitive angular part of the rotation of the at least one shaft 12 for selectively communicating the at least one common shared fluid passage 16 with the corresponding one of the at least one expandable fluid chamber 50. It should be recognized that a similar modification for each of the annular groove segments and corresponding fluid communication ports illustrated and described in the configurations of FIGS. 1-6 and 8-9 is within the scope of the disclosed invention.

Figure 1:
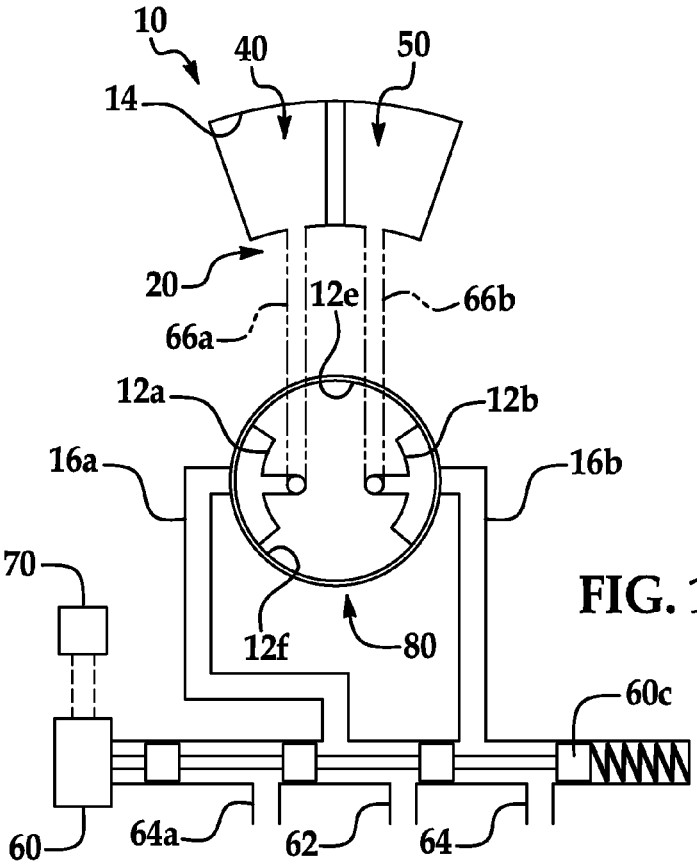
FIG. 1 is a simplified schematic of a variable cam timing phaser having a drive stator, a driven rotor, a control valve, two common shared fluid passages and a rotatable fluid flow diverter in a first angular position of rotation.
Figure 2:
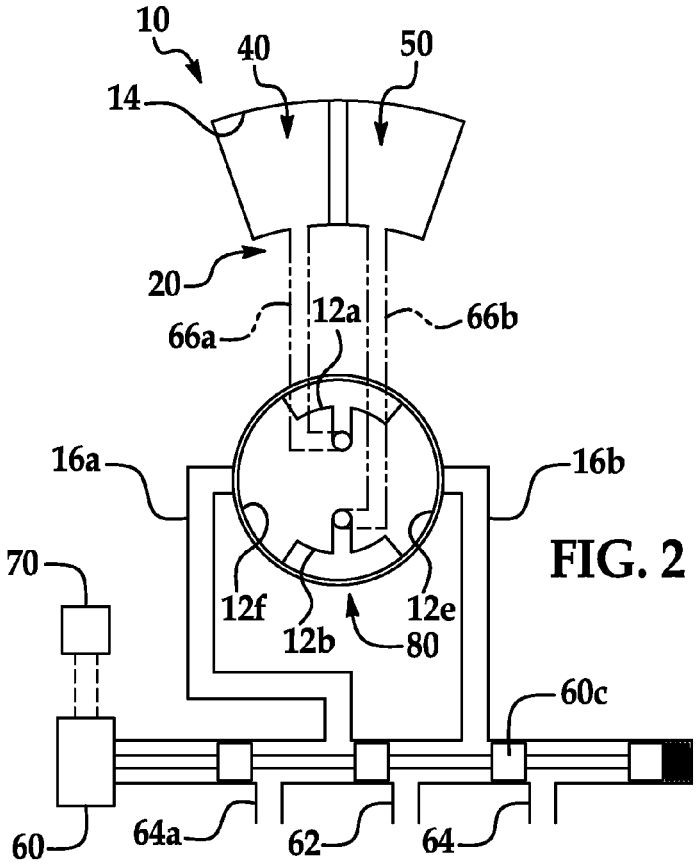
FIG. 2 is a simplified schematic of a variable cam timing phaser having a drive stator, a driven rotor, a control valve, two common shared fluid passages and a rotatable fluid flow diverter in a second angular position of rotation.
Figure 3:
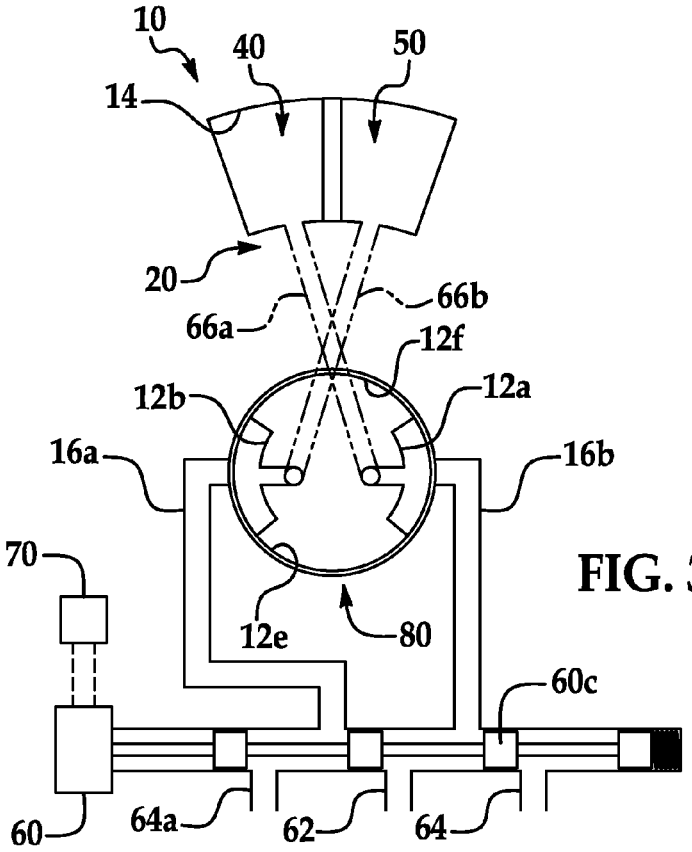
FIG. 3 is a simplified schematic of a variable cam timing phaser having a drive stator, a driven rotor, a control valve, two common shared fluid passages and a rotatable fluid flow diverter in a third angular position of rotation.

Referring now to FIGS. 1-3, the variable cam timing phaser 10 is similar to that shown and described with respect to FIG. 7, except the at least one common shared fluid passage 16 can include first and second common shared fluid passages 16*a*, 16*b* in fluid communication with the first and second expandable fluid chambers 40, 50 through corresponding first and second fluid passages 66*a*, 66*b*, and an additional port, inlet or outlet, for the control valve 60. By way of example and not limitation, FIGS. 1-3 illustrate an additional outlet port 64*a* for purposes of describing the operation of the variable cam timing phaser 10. However, it should be recognized that the inlet port 62 and outlet ports 64, 64*a* can be reversed to provide the opposite function from that described hereinafter. By way of example and not limitation, as illustrated in FIG. 1, the control valve 60 is shifted to the left from a null position allowing fluid communication from the inlet port 62 to the first expandable fluid chamber 40 through first common shared fluid passage 16*a*, annular groove segment 12*a*, and first fluid flow passage 66*a*, while simultaneously allowing fluid communication from the outlet port 64 to the second expandable fluid chamber 50 through second common shared fluid passage 16*b*, annular groove segment 12*b*, and second fluid flow passage 66*b*.

As illustrated in FIG. 2, the control valve is shifted to the right from the null position allowing fluid communication from the outlet port 64*a* to the first common shared fluid passage 16*a*, while simultaneously allowing fluid communication from the inlet port 62 to the second common shared fluid passage 16*b*. The fluid flow diverter 80 associated with shaft 12 has rotated clockwise to isolate the first and second expandable fluid chambers 40, 50 from the first and second common shared fluid passages 16*a*, 16*b* with outer diameter lands 12*e*, 12*f* during another angular part of the rotation of shaft 12. It should be recognized that the angular extent of the groove segments 12*a*, 12*b* and the angular extent of the outer diameter lands 12*e*, 12*f* can be any desired non-overlapping angular degree of coverage.

As illustrated in FIG. 3, as the fluid flow diverter 80 associated with the shaft 12 rotates further in the clockwise direction, the outlet port 64*a* is brought into fluid communication with the second expandable fluid chamber 50 through the first common shared fluid passage 16*a*, the annular groove segment 12*b*, and the second fluid passage portion 66*b*, while simultaneously the inlet port 62 is brought into fluid communication with the first expandable fluid chamber 40 through the second common shared fluid passage 16*b*, the annular groove segment 12*a*, and the first fluid passage portion 66*a*. It should be recognized that the control valve 60 can be in either the shifted right position illustrated in FIGS. 2 and 3 or in the shifted left position illustrated in FIG. 1, or in a null position as illustrated in FIG. 4, while the fluid flow diverter 80 can be rotated through an appropriate angular orientation to allow fluid communication between the first and second common shared fluid flow passage 16*a*, 16*b* and the first and second fluid passage portions 66*a*, 66*b* through corresponding groove segments 12*a*, 12*b* to communicate with the corresponding first and second expandable fluid chambers 40, 50.

Figure 4:
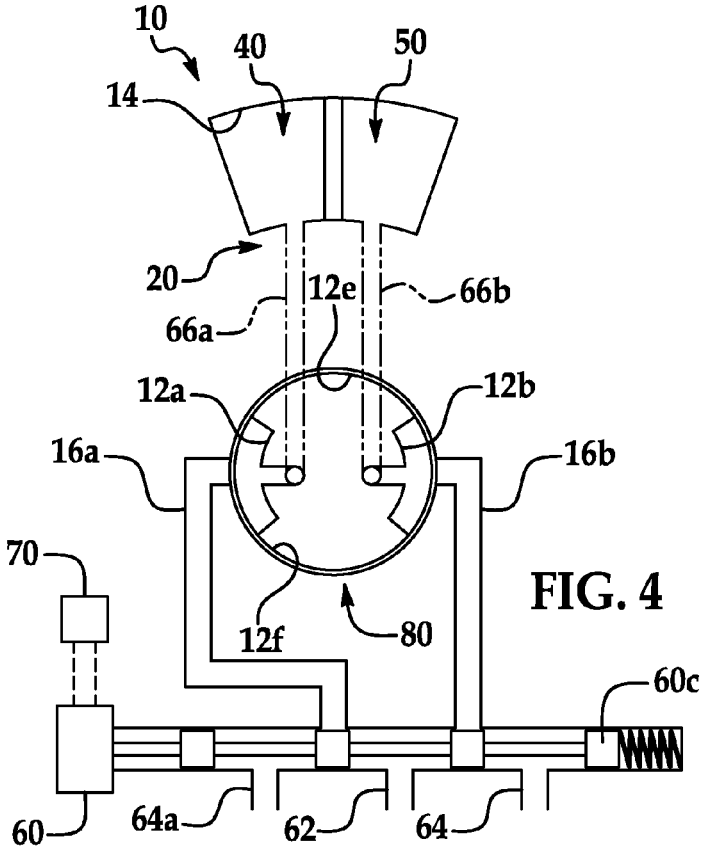
FIG. 4 is a simplified schematic view of a spool of the control valve of FIGS. 1-3 in a null position.

The central null position of the control valve 60 is illustrated in FIG. 4. The null position closes fluid communication between the inlet port 62 and outlet ports 64, 64*a* with the shared fluid passages 16*a*, 16*b*. The angular position, or phase angle, of the stator 14 and rotor 20 can be held stationary with respect to one another when the control valve 60 is in the null position, as the fluid flow diverter 80 rotates.

The annular groove segments 12*a*, 12*b* can be angularly positioned to benefit from oscillating torque. Phaser control can be accomplished by moving the control valve 60 away from a central null position to the shifted left position shown in FIG. 1, or shifted right position shown in FIGS. 2 and 3, while the annular groove segments 12*a*, 12*b* align with the first and/or second common shared fluid passages 16, 16*b* and move back to the central null position to close off flow until the desired alignment repeats. The control valve 60 can move back away from the central null position to continue phaser motion when the desired alignment repeats. Alternatively, the control valve 60 can be oscillated in both directions from the central null position during one revolution of shaft 12. An alternative control strategy for shared oil feed phasers can include oscillation of the control valve 60 around a null position at the cam rotation frequency or at fractional multiples of cam rotation frequency. The engine control unit can advance or retard the timing of the control valve 60 motion to overlap more or less with the portion of the cam rotation where annular groove segments 12*a*, 12*b* allow fluid flow in or out of the connected expandable fluid chambers 40, 50. In other words, the control valve 60 is not held at a null position; instead flow from the control valve to the phaser is opened or closed by varying the overlap of the control valve 60 opening of the inlet ports 62 and/or outlet ports 64, 64*a* and the annular groove segment 12*a*, 12*b* openings being in fluid communication with a common shared fluid passage 16*a*, 16*b*.

It should be recognized that the annular groove segments 12*a*, 12*b* and outer diameter lands 12*e*, 12*f* can be equally angularly spaced as illustrated, or can be positioned in any non-overlapping angular extent and orientation desired. When the segments 12*a*, 12*b* and lands 12*e*, 12*f* are equally angularly spaced, the first and second expandable fluid chambers 40, 50 are simultaneously in fluid communication or simultaneously isolated depending on the angular position of the shaft 12 and associated fluid flow diverter 80. When the segments 12*a*, 12*b* and lands 12*e*, 12*f* are not equally angularly spaced, the fluid communication and isolation of the first and second expandable chambers 40, 50 are offset in time with respect to one another depending on the angular position of the shaft 12 and associated fluid flow diverter 80.

While first and second fluid passages 66*a*, 66*b* are shown schematically crossing in FIG. 3, it should be recognized that these fluid passages 66*a*, 66*b* can include annular grooves formed around a circumferential periphery of the shaft 12 and spaced axially from one other for connecting to the corresponding first and second expandable fluid chambers 40, 50 in any angular orientation of the shaft 12 as is conventional and known.

Figure 5:
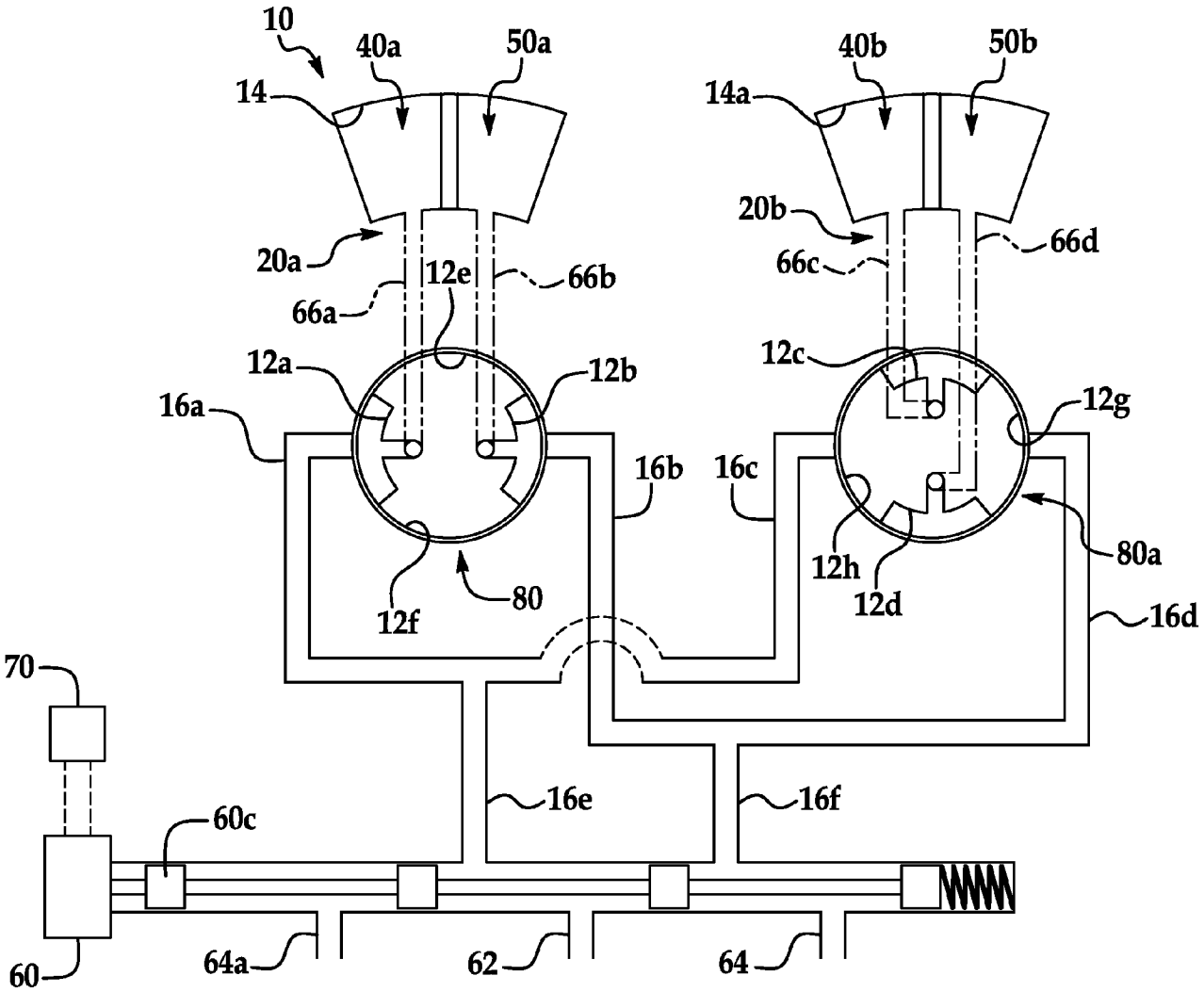
FIG. 5 is a simplified schematic of a variable cam timing phaser having a drive stator, two driven rotors, a common shared control valve, four common shared fluid passages and a rotatable fluid flow diverter in a first angular position of rotation.
Figure 6:
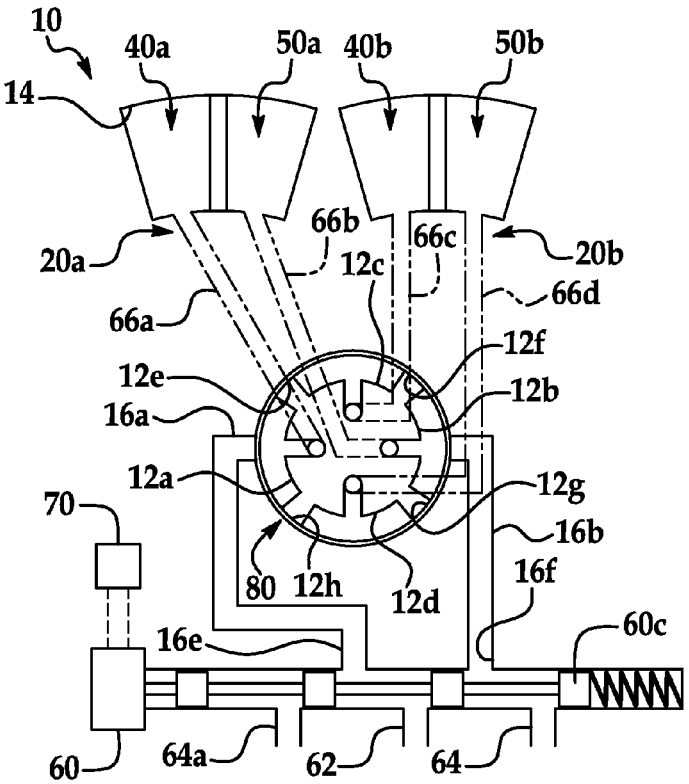
FIG. 6 is a simplified schematic of a variable cam timing phaser having a drive stator, a driven rotor, a control valve, four common shared fluid passages and a rotatable fluid flow diverter in a first angular position of rotation.

Referring now to FIG. 5, the variable cam timing phaser 10 is similar to that shown and described with respect to FIGS. 1-3, except this configuration is for a dual variable cam timing phaser 10 having a first driven rotor 20*a* and a second driven rotor 20*b* independently rotatable with respect to one another and to one or more drive stator 14, 14*a*. The at least one common shared fluid passage 16 can include first, second, third and fourth common shared fluid passages 16*a*, 16*b*, 16*c*, 16*d* in fluid communication with the first, second, third, and fourth expandable fluid chambers 40*a*, 50*a*, 40*b*, 50*b* of respective driven rotor 20*a*, 20*b* through corresponding first, second, third, and fourth fluid passages 66*a*, 66*b*, 66*c*, 66*d*. The control valve 60 can be similar to that shown and described in FIGS. 1-4 with one port 16*e* branching into fluid passages 16*a*, 16*c* and another port 16*f* branching into fluid passages 16*b*, 16*d*. By way of example and not limitation, as illustrated in FIG. 5, the control valve 60 can be shifted to the left from a central null position allowing simultaneous fluid communication in the following manner: first, from the inlet port 62 to the first expandable fluid chamber 40*a* through port 16*e* to the first common shared fluid passage 16*a*, through annular groove segment 12*a*, and first fluid flow passage 66*a*; and second, from the outlet port 64 to the second expandable fluid chamber 50*a* through port 16*f* to the second common shared fluid passage 16*b*, through annular groove segment 12*b*, and second fluid flow passage 66*b*. As illustrated in FIG. 5, the rotatable fluid flow diverter 80*a* is offset 90° from fluid flow diverter 80. In this illustrated angular position, fluid flow diverter 80*a* blocks fluid communication with expandable fluid chambers 40*b*, 50*b*.

When the control valve 60 of FIG. 5 is shifted to the right (not shown) from the central null position, and the fluid flow diverter valves 80, 80*a* are in the illustrated positions of FIG. 5, fluid communication is allowed in the following manner: first, from the inlet port 62 to the first expandable fluid chamber 50*a* through port 16*f* to the second common shared fluid passage 16*b*, through annular groove segment 12*b*, and second fluid flow passage 66*b*; and second, from the outlet port 64*a* to the first expandable fluid chamber 40*a* through port 16*e* to first common shared fluid passage 16*a*, through annular groove segment 12*a*, and first fluid flow passage 66*a*.

When the control valve 60 is in the central null position, similar to the position illustrated in FIG. 4, fluid flow to the expandable chambers 40*a*, 50*a*, 40*b*, 50*b* is prevented by the reciprocal spool blocking fluid flow through ports 16*e*, 16*f*, while the rotatable fluid flow diverters 80, 80*a* are rotated through any desired angular movement.

As the rotatable fluid flow diverters 80, 80*a* rotate from the positions shown in FIG. 5 through 90° of clockwise rotation, fluid flow diverter 80 moves into a fluid flow blocking position preventing further fluid flow communication with expandable chambers 40*a*, 50*a*, and fluid flow diverter 80*a* moves into a fluid flow allowing position permitting fluid flow communication with expandable chambers 40*b*, 50*b*. With the rotatable fluid flow diverters 80, 80*a* in the 90° angular clockwise rotation position, and the control valve 60 in the shifted left illustrated position of FIG. 5, fluid communication is simultaneously allowed as follows: first, from the inlet port 62 to the third expandable fluid chamber 40*b* through port 16*e* to the third common shared fluid passage 16*c*, through annular groove segment 12*d*, and fourth fluid flow passage 66*d*; and second, from the outlet port 64 to the fourth expandable fluid chamber 50*b* through port 16*f* to fourth common shared passage 16*d*, through annular groove segment 12*c*, and third fluid flow passage 66*c*.

As the rotatable fluid flow diverters 80, 80*a* rotate from the positions shown in FIG. 5 through 90° of clockwise rotation and with the control valve 60 shifted to the right (not shown) from the central null position, fluid flow diverter 80 moves into a fluid flow blocking position preventing further fluid flow communication with expandable chambers 40*a*, 50*a*, and fluid flow diverter 80*a* moves into a fluid flow allowing position permitting fluid flow communication with expandable chambers 40*b*, 50*b*. With the rotatable fluid flow diverters 80, 80*a* in the 90° angular clockwise rotation position, and the control valve 60 in the shifted right (not shown), fluid communication is simultaneously allowed as follows: first, from the inlet port 62 to the fourth expandable fluid chamber 50*b* through port 16*f* to the fourth common shared fluid passage 16*d*, through annular groove segment 12*c*, and third fluid flow passage 66*c*; and second, from the outlet port 64*a* to the third expandable fluid chamber 40*b* through port 16*e* to third common shared passage 16*c*, through annular groove segment 12*d*, and fourth fluid flow passage 66*d*.

As can be determined through comparison of FIGS. 1-3 with FIG. 5, when the fluid flow diverter 80 on the left hand side is rotated clockwise approximately 180° from the position illustrated in FIG. 5, to a position similar to that shown in FIG. 3, and the fluid flow diverter 80*a* on the right hand side is rotated clockwise approximately 180° from the position shown in FIG. 5, with the control valve 60 shifted left as illustrated as illustrated in FIG. 5, fluid communication is allowed in the following manner: first, from the outlet port 64 to the first expandable fluid chamber 40*a* through port 16*f* to the second common shared fluid passage 16*b*, through annular groove segment 12*a*, and first fluid flow passage 66*a*; and second, from the inlet port 62 to the second expandable fluid chamber 50*a* through port 16*e* to the first common shared fluid passage 16*a*, through annular groove segment 12*b*, and second fluid flow passage 66*b*. Fluid flow diverter 80*a* is in a fluid flow communication blocking position preventing fluid flow with expandable chambers 40*b*, 50*b*.

When the control valve 60 of FIG. 5 is shifted to the right (not shown), and the fluid flow diverter 80 on the left hand side is rotated clockwise approximately 180° from the position illustrated in FIG. 5, to a position similar to that shown in FIG. 3, and the fluid flow diverter 80*a* on the right hand side is rotated clockwise approximately 180° from the position shown in FIG. 5, fluid communication is allowed in the following manner: first, from the inlet port 62 to the first expandable fluid chamber 40*a* through fluid port 16*f* to the second common shared fluid passage 16*b*, annular groove segment 12*a*, and first fluid flow passage 66*a*; and second, from the outlet port 64*a* to the second expandable fluid chamber 50*a* through first common shared fluid passage 16*a*, annular groove segment 12*b*, and second fluid flow passage 66*b*. Fluid flow diverter 80*a* is in a fluid flow communication blocking position preventing fluid flow with expandable chambers 40*b*, 50*b*.

As can be determined through comparison of FIGS. 1-3 with FIG. 5, when the fluid flow diverter 80 on the left hand side is rotated clockwise approximately 270° from the position illustrated in FIG. 5, and the fluid flow diverter 80*a* on the right hand side is rotated clockwise approximately 270° from the position shown in FIG. 5, with the control valve 60 shifted left as illustrated in FIG. 5, fluid communication is allowed in the following manner: first, from the outlet port 64 to the fourth expandable fluid chamber 50*b* through port 16*f* to the fourth common shared fluid passage 16*d*, through annular groove segment 12*d*, and fourth fluid flow passage 66*d*; and second, from the inlet port 62 to the third expandable fluid chamber 40*b* through port 16*e* to the third common shared fluid passage 16*c*, through annular groove segment 12*c*, and third fluid flow passage 66*c*. Fluid flow diverter 80 is in a fluid flow communication blocking position preventing fluid flow with expandable chambers 40*a*, 50*a*.

As can be determined through comparison of FIGS. 1-3 with FIG. 5, when the fluid flow diverter 80 on the left hand side is rotated clockwise approximately 270° from the position illustrated in FIG. 5, and the fluid flow diverter 80*a* on the right hand side is rotated clockwise approximately 270° from the position shown in FIG. 5, with the control valve 60 shifted right (not shown) from the position illustrated in FIG. 5, fluid communication is allowed in the following manner: first, from the outlet port 64*a* to the third expandable fluid chamber 40*b* through port 16*e* to the third common shared fluid passage 16*c*, through annular groove segment 12*c*, and third fluid flow passage 66*c*; and second, from the inlet port 62 to the fourth expandable fluid chamber 50*b* through port 16*f* to the fourth common shared fluid passage 16*d*, through annular groove segment 12*d*, and fourth fluid flow passage 66*d*. Fluid flow diverter 80 is in a fluid flow communication blocking position preventing fluid flow with expandable chambers 40*a*, 50*a*.

It should be recognized that the angular extent of the first group of groove segments 12*a*, 12*b* and the angular extent of the corresponding first group of outer diameter lands 12*e*, 12*f* can be any desired non-overlapping angular degree of coverage. When the segments 12*a*, 12*b* and lands 12*e*, 12*f* are equally angularly spaced, the first and second expandable fluid chambers 40*a*, 50*a* are simultaneously in fluid communication or simultaneously isolated depending on the angular position of the shaft 12 and associated fluid flow diverter 80, and the position of the control valve 60. When the segments 12*a*, 12*b* and lands 12*e*, 12*f* are not equally angularly spaced, the fluid communication and isolation of the first and second expandable chambers 40*a*, 50*a* are offset in time with respect to one another depending on the angular position of the shaft 12 and the associated fluid flow diverter 80, and the position of the control valve 60. Likewise, the angular extent of the second group of groove segments 12*c*, 12*d* and the angular extent of the corresponding second group of outer diameter lands 12*g*, 12*h* can be any desired non-overlapping angular degree of coverage. When the segments 12*c*, 12*d* and lands 12*g*, 12*h* are equally angularly spaced, the third and fourth expandable fluid chambers 40*b*, 50*b* are simultaneously in fluid communication or simultaneously isolated depending on the angular position of the shaft 12 and the associated fluid flow diverter 80*a*, and the position of the control valve 60. When the segments 12*c*, 12*d* and lands 12*g*, 12*h* are not equally angularly spaced, the fluid communication and isolation of the third and fourth expandable chambers 40*b*, 50*b* are offset in time with respect to one another depending on the angular position of the shaft 12 and the associated fluid flow diverter 80*a*, and the position of the control valve 60. The first and second groups of segments and lands can be any desired angular orientation with respect to one another, either offset by ninety degrees, as illustrated in FIG. 5 by way of example and not limitation, or any other desired angular orientation. It should be recognized that the control valve 60 can be in either the shifted left position illustrated in FIG. 5 or in the shifted right position (not shown), or in a null position (not shown), while the fluid flow diverters 80, 80*a* can be rotated through an appropriate angular orientation to allow fluid communication between the first, second, third, and fourth common shared fluid flow passage 16*a*, 16*b*, 16*c*, 16*d* and the first, second, third and fourth fluid passage portions 66*a*, 66*b*, 66*c*, 66*d* through corresponding groove segments 12*a*, 12*b*, 12*b*, 12*c* to communicate with the corresponding first, second, third, and fourth expandable fluid chambers 40*a*, 50*a*, 40*b*, 50*b*. It should be recognized that the two shaft cross sections corresponding to fluid flow diverters 80, 80*a*, illustrated in FIG. 5 can be from different axially spaced apart locations along the same shaft 12, or can be from axial locations on different shafts.

Referring now to FIG. 6, the variable cam timing phaser 10 is similar to that shown and described with respect to FIG. 5, this configuration is also for a dual variable cam timing phaser 10 having a first driven rotor 20*a* and a second driven rotor 20*b* independently rotatable with respect to one another and to one or more drive stator 14, 14*a* except that the fluid flow diverter 80 includes first, second, third, and fourth groove segments 12*a*, 12*b*, 12*c*, 12*d* located at a single axial location on shaft 12. The at least one common shared fluid passage 16 can include first and second common shared fluid passages 16*a*, 16*b* in fluid communication with the first, second, third, and fourth expandable fluid chambers 40*a*, 50*a*, 40*b*, 50*b* of respective driven rotors 20*a*, 20*b* through corresponding first, second, third and fourth fluid passages 66*a*, 66*b*, 66*c*, 66*d* when in fluid communication through groove segments 12*a*, 12*b*, 12*c*, 12*d* located on rotatable fluid flow diverter 80.

By way of example and not limitation, FIG. 6 illustrate a common inlet port 62 and common outlet ports 64, 64*a* for purposes of describing the operation of the dual variable cam timing phaser 10 configuration. However, it should be recognized that the inlet port 62 and outlet ports 64, 64*a* can be reversed to provide the opposite function from that described hereinafter. By way of example and not limitation, as illustrated in FIG. 6, the control valve 60 is shifted to left allowing simultaneous fluid communication in the following manner: first, from the inlet port 62 to the first expandable fluid chamber 40*a* through the first common shared fluid passage 16*a*, annular groove segment 12*a*, and first fluid flow passage 66*a*; and second, from the outlet port 64 to the second expandable fluid chamber 50*a* through second common shared fluid passage 16*b*, annular groove segment 12*b*, and second fluid flow passage 66*b*. The groove segments 12*c*, 12*d* are in a fluid flow blocking position preventing fluid communication with expandable chambers 40*b*, 50*b*.

When the control valve 60 of FIG. 6 is shifted to the right (not shown), fluid communication is allowed in the following manner: first, from the outlet port 64*a* to the first expandable fluid chamber 40*a* through the first common shared fluid passage 16*a*, annular groove segment 12*a*, and first fluid flow passage 66*a*; and second, from the inlet port 62 to the second expandable fluid chamber 50*a* through second common shared fluid passage 16*b*, annular groove segment 12*b*, and second fluid flow passage 66*b*. The groove segments 12*c*, 12*d* are in a fluid flow blocking position preventing fluid communication with expandable chambers 40*b*, 50*b*.

When the control valve 60 is in the central null position, similar to that illustrated in FIG. 4, fluid communication between the inlet port 62 and outlet ports 64, 64*a* with the shared fluid passages 16*a*, 16*b* is prevented. The angular position, or phase angle, of the stator 14 and rotor 20 can be held stationary with respect to one another when the control valve 60 is in the null position, as the fluid flow diverter 80 rotates.

As can be determined through close examination of FIG. 6, when the fluid flow diverter 80 is rotated clockwise approximately 45° or 225° from the position illustrated in FIG. 6, the first, second, third, and fourth expandable fluid chambers 40*a*, 50*a*, 40*b*, 50*b* are isolated from fluid communication with the first and second common shared fluid passages 16*a*, 16*b* as outer diameter lands 12*f* and 12*h* (or 12*e* and 12*g* when rotated clockwise 135° or 315° from the position illustrated in FIG. 6) block fluid communication with the annular groove segments 12*a*, 12*b*, 12*c*, 12*d*.

As can be determined through close examination of FIG. 6, when the fluid flow diverter 80 is rotated clockwise approximately 90° from the position illustrated in FIG. 6, with the control valve 60 shifted left as illustrated in FIG. 6, fluid communication is allowed in the following manner: first, from the inlet port 62 to the fourth expandable fluid chamber 50*b* through the first common shared fluid passage 16*a*, annular groove segment 12*d*, and fourth fluid flow passage 66*d*; and second, from the outlet port 64 to the third expandable fluid chamber 40*b* through second common shared fluid passage 16*b*, annular groove segment 12*c*, and third fluid flow passage 66*c*. The groove segments 12*a*, 12*b* are in a fluid flow blocking position preventing fluid communication with expandable chambers 40*a*, 50*a*.

As can be determined through close examination of FIG. 6, when the fluid flow diverter 80 is rotated clockwise approximately 90° from the position illustrated in FIG. 6, with the control valve 60 of FIG. 6 shifted to the right (not shown), fluid communication is allowed in the following manner: first, from the outlet port 64*a* to the fourth expandable fluid chamber 50*b* through the first common shared fluid passage 16*a*, annular groove segment 12*d*, and fourth fluid flow passage 66*d*; and second, from the inlet port 62 to the third expandable fluid chamber 40*b* through second common shared fluid passage 16*b*, annular groove segment 12*c*, and third fluid flow passage 66*c*. The groove segments 12*a*, 12*b* are in a fluid flow blocking position preventing fluid communication with expandable chambers 40*a*, 50*a*.

As the fluid flow diverter 80 and associated shaft 12 are rotated clockwise through approximately 180° from the position illustrated in FIG. 6, with the control valve 60 shifted to the left as illustrated in FIG. 6, fluid communication is allowed in the following manner: first, from the inlet port 62 to the second expandable chamber 50*a* through the first common shared fluid passage 16*a*, annular groove segment 12*b* and second fluid flow passage 66*b*; and second, from the outlet port 64 to the first expandable chamber 40*a* through the second common shared fluid passage 16*b* through annular groove segment 12*a* and first fluid passage 66*a*. The groove segments 12*c*, 12*d* are in a fluid flow blocking position preventing fluid communication with expandable chambers 40*b*, 50*b*.

As the fluid flow diverter 80 and associated shaft 12 are rotated clockwise through approximately 180° from the position illustrated in FIG. 6, with the control valve 60 shifted to the right (not shown), fluid communication is allowed in the following manner: first, from the outlet port 64*a* to the second expandable chamber 50*a* through the first common shared fluid passage 16*a*, annular groove segment 12*b* and second fluid flow passage 66*b*; and second, from the inlet port 62 to the first expandable chamber 40*a* through the second common shared fluid passage 16*b* through annular groove segment 12*a* and first fluid passage 66*a*. The groove segments 12*c*, 12*d* are in a fluid flow blocking position preventing fluid communication with expandable chambers 40*b*, 50*b*.

As the fluid flow diverter 80 and associated shaft 12 are rotated clockwise through approximately 270° from the position illustrated in FIG. 6 with the control valve 60 shifted to the left as illustrated in FIG. 6, fluid communication is allowed in the following manner: first, from inlet port 62 to the third expandable chamber 40*b* through the first common shared fluid passage 16*a* through annular groove segment 12*c* and third fluid flow passage 66*c*; and second, from outlet port 64 to the fourth expandable chamber 50*b* through the second common shared fluid passage 16*b*, annular groove segment 12*d* and fourth fluid passage 66*d*. The groove segments 12*a*, 12*b* are in a fluid flow blocking position preventing fluid communication with expandable chambers 40*a*, 50*a*.

As the fluid flow diverter 80 and associated shaft 12 are rotated clockwise through approximately 270° from the position illustrated in FIG. 6 with the control valve 60 shifted to the right (not shown), fluid communication is allowed in the following manner: first, from outlet port 64*a* to the third expandable chamber 40*b* through the first common shared fluid passage 16*a* through annular groove segment 12*c* and third fluid flow passage 66*c*; and second, from inlet port 62 to the fourth expandable chamber 50*b* through the second common shared fluid passage 16*b*, annular groove segment 12*d* and fourth fluid passage 66*d*. The groove segments 12*a*, 12*b* are in a fluid flow blocking position preventing fluid communication with expandable chambers 40*a*, 50*a*.

It should be recognized that the first, second, third, and fourth expandable fluid chambers 40*a*, 50*a*, 40*b*, 50*b* can be in fluid communication with the inlet port 62 or the outlet port 64, 64*a* through operation of control valve 60 as previously described when in any angular position in fluid communication with the first and second common shared fluid passages 16*a*, 16*b*. When the control valve 60 is in the central null position, similar to the position illustrated in FIG. 4, fluid flow to the expandable chambers 40*a*, 50*a*, 40*b*, 50*b* is prevented by the reciprocal spool blocking fluid flow through ports 16*e*, 16*f*, while the rotatable fluid flow diverter 80 is rotated through any desired angular movement.

It should be recognized that the angular extent of the annular groove segments 12*a*, 12*b*, 12*c*, 12*d* and the angular extent of the outer diameter lands 12*e*, 12*f*, 12*g*, 12*h* can be any desired non-overlapping angular degree of coverage. When the segments 12*a*, 12*b*, 12*c*, 12*d* and lands 12*e*, 12*f*, 12, 12*h* are equally angularly spaced, the first/second and third/fourth expandable fluid chambers 40*a*/50*a*, 40*b*/50*b* are simultaneously in fluid communication or simultaneously isolated depending on the angular position of the shaft 12 and associated fluid flow diverter 80, and the position of the control valve 60. When the segments 12*a*, 12*b*, 12*c*, 12*d* and lands 12*e*, 12*f*, 12*g*, 12*h* are not equally angularly spaced, the fluid communication and isolation of the first/second and third/fourth expandable chambers 40*a*/50*a*, 40*b*/50*b* are offset in time with respect to one another depending on the angular position of the shaft 12 and associated fluid flow diverter 80, and the position of the control valve 60. It should be recognized that the control valve 60 can be in either the shifted left position illustrated in FIG. 6 or in the shifted right position (similar to FIG. 2), or in a null position (similar to FIG. 4), while the fluid flow diverter 80 can be rotated through an appropriate angular orientation to allow fluid communication between the first and second common shared fluid flow passage 16*a*, 16*b* and the first, second, third and fourth fluid passage portions 66*a*, 66*b*, 66*c*, 66*d* through corresponding groove segments 12*a*, 12*b*, 12*b*, 12*c* to communicate with the corresponding first, second, third, and fourth expandable fluid chambers 40*a*, 50*a*, 40*b*, 50*b*.

The annular groove segments 12*a*, 12*b*, 12*c*, 12*d* can be angularly positioned to benefit from oscillating torque. Phaser control can be accomplished by moving the control valve 60 away from a central null position to the shifted left position shown in FIG. 6, or shifted right position (similar to FIG. 2), while the annular groove segments 12*a*/12*b* and 12*c*/12*d* alternately align with the first and second common shared fluid passages 16, 16*b* and move back to the central null position to close off flow until the desired alignment repeats. The control valve 60 can move away from the central null position to continue phaser motion when the desired alignment repeats.

Alternatively, the control valve 60 can be oscillated in both directions from the central null position during one revolution of shaft 12. An alternative control strategy for shared oil feed phasers can include oscillation of the control valve 60 around a null position at the cam rotation frequency or at fractional multiples of cam rotation frequency. The engine control unit can advance or retard the timing of the control valve 60 motion to overlap more or less with the portion of the cam rotation where annular groove segments 12*a*, 12*b*, 12*c*, 12*d* allow fluid flow in or out of the connected expandable fluid chambers 40*a*, 50*a*, 40*b*, 50*b*. In other words, the control valve 60 is not held at a null position; instead flow from the control valve 60 to the phaser is opened or closed by varying the overlap of the control valve 60 opening of the inlet port 62 and/or outlet ports 64, 64*a* and the annular groove segment 12*a*, 12*b*, 12*c*, 12*d* openings being in fluid communication with the first and second common shared fluid passage 16*a*, 16*b*.

In summary, pressurized oil is typically supplied across a camshaft bearing to a cam phaser by connecting each port from the control valve with separate continuous grooves in the camshaft bearing. The illustrated configurations interrupt the groove in the cam bearing into two or more segments 12*a*, 12*b*, 12*c*, 12*d* aligned axially with one another or separated into groups having axial alignment within each group and each group axially spaced from any other group, or each group located on a different shaft from any other group, or any combination thereof. Each annular groove segment 12*a*, 12*b*, 12*c*, 12*d* is connected to a different expandable fluid chamber 40*a*, 50*a*, 40*b*, 50*b* in the cam phaser or cam phasers. The operation of the control valve 60 is then timed relative to the rotational position of the camshaft 12 (and segments of the groove 12*a*, 12*b*, 12*c*, 12*d*) in order to control multiple functions in the cam phaser, or phasers, with multiple axially spaced annular grooves being replaced by at least one groove segment located in a common axial plane, or by at least one group of groove segments, where in multiple groups each group of groove segments is located spaced axially (or on a different shaft) from other groups of groove segments and where each groove segment in a particular group is located in a common axial plane. This would allow a control valve 60 to operate a phaser through at least one groove having multiple annular groove segments 12*a*, 12*b*, 12*c*, 12*d* in the cam bearing. Additionally, one control valve 60 could be used to operate two separate phasers 10*a*, 10*b* using two groups of multiple annular groove segments instead of the typical four annular groove configuration. By way of example and not limitation, such as illustrated in FIG. 5, where a first group can include annular groove segments 12*a*, 12*b* with outer diameter lands 12*e*, 12*f* separating the segments 12*a*, 12*b* from one another, and a second group can include annular groove segments 12*c*, 12*d* with outer diameter lands 12*g*, 12*h* separating segments 12*c*, 12*d* from one another, or such as illustrated in FIG. 6, using a single groove having four annular segments 12*a*, 12*b*, 12*c*, 12*d*, each separated by a corresponding outer diameter land 12*e*, 12*f*, 12*g*, 12*h*.

It should be recognized that a segmented groove can be provided in a cam bearing (or in any rotating shaft). A control valve can be used to port oil pressure to the segments of the groove independently. The disclosed configuration allows the use of one control valve to operate two hydraulically controlled devices, such as cam phasers. This idea which, in effect, creates multiple control channels in a hydraulic control valve circuit could potentially be used in applications unrelated to cam phasers. The basic idea of splitting the hydraulic control line and using the control valve to operate two hydraulic devices independently is not specific to cam phasers.

Figure 8:
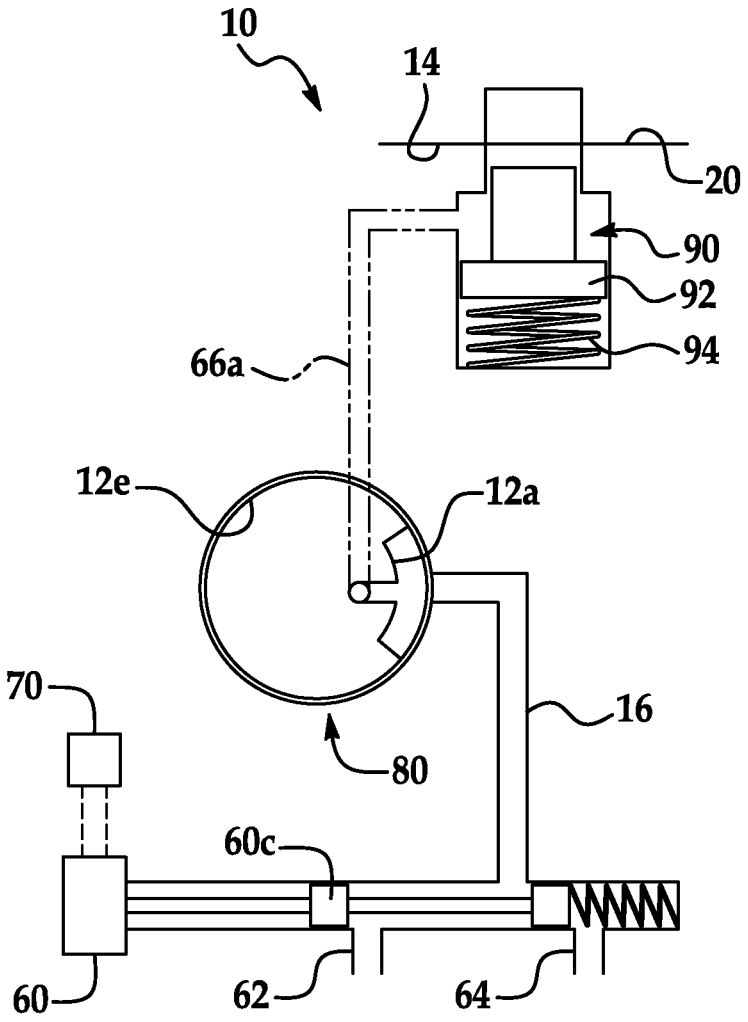
FIG. 8 is a simplified schematic of a pressurized fluid control system having at least two members defining at least one expandable fluid chamber therebetween and movable with respect to one another in response to fluid flow into and out of the at least one expandable fluid chamber, a control valve, at least one rotatable fluid flow diverter, wherein one of the at least two members includes a locking pin.

Referring now to FIG. 8, a pressurized fluid control system can include at least two members 14, 20, 92 defining at least one expandable fluid chamber 90 therebetween and movable with respect to one another in response to fluid flow into and out of the at least one expandable fluid chamber 90. A control valve 60 can have at least one inlet port 62, at least one outlet port 64, and at least one common shared fluid passage 16. At least one rotatable fluid flow diverter 80 can be in fluid communication with the at least one common shared fluid passage 16 for selectively communicating the at least one common shared fluid passage 16 with the at least one expandable fluid chamber 90. The at least two members can include a locking pin 92 movable with respect to a stator 14 and at least one rotor 20 in response to pressurized fluid introduced into the at least one expandable fluid chamber 90 for unlocking the angular position of the stator 14 and at least one rotor 20 with respect to one another. As illustrated in FIG. 8, the control valve 60 is shifted to the left to place the inlet port 62 in fluid communication with the at least one expandable fluid chamber 90 through common shared fluid passage 16, annular groove segment 12*a*, and fluid passage 66*a*, thereby driving the locking pin 92 against the urgings of mechanical biasing spring 94 toward an unlocked position so that the stator 14 and at least one rotor 20 can move relative to one another. When the control valve 60 is shifted to the right (not shown), the common shared fluid passage 16 is placed in fluid communication with the outlet port 64 expelling pressurized fluid through the at least one common shared fluid passage 16, annular groove segment 12*a*, and fluid passage 66*a*, while the locking pin 92 is biased by a mechanical spring 94 toward the locked position to maintain a fixed angular position of the stator 14 with respect to the rotor 20. It should be recognized that the pressurized fluid control system and locking pin configuration can be incorporated and used in combination with any of the variable cam timing phaser configurations illustrated in FIGS. 1-7.

The oil path sharing and/or timed oil supply through the fluid flow diverter 80, 80*a* according to one configuration can include at least one common shared passage 16, 16*a*, 16*b*, 16*c*, 16*d* in fluid communication with a source of pressurized fluid or an exhaust for pressurized fluid via a control valve 60 to be selectively connected to multiple output locations, by way of example and not limitation, such as, either, two sides of a single vane (i.e. first and second expandable fluid chambers 40, 50), or one side of two vanes (i.e. first and third expandable fluid chambers 40*a*, 40*b*, if spring biased in one direction). The multiple outlets can be rotationally located such that the outlets are in the best place to move the phaser based on torque forces. A high gain, high frequency response valve 60 can be used to have pressure and flow available when needed and exhaust when needed. The bearing can act as a check valve when the feed apertures are not aligned between the common shared passages 16, 16*a*, 16*b*, 16*c*, 16*d* and the annular groove segments 12*a*, 12*b*, 12*c*, 12*d*. The phaser motion can be throttled by varying the overlap of the feed apertures of the common shared passages 16, 16*a*, 16*b*, 16*c*, 16*d* and the annular groove segments 12*a*, 12*b*, 12*c*, 12*d*. The at least one feed/shared oil passage 16, 16*a*, 16*b*, 16*c*, 16*d* can feed both sides of a vane with the same oil feed through the cam bearing, and can pulse the cam pressure based on cam position, or can feed and vent a single side of a vane. A single control valve 60 can be used to control two rotors 20*a*, 20*b* by moving the control valve 60 between operational advance/retard positions and a null position. The control valve 60 can control one rotor 20*a* only while the corresponding annular groove segments are aligned, then move, as necessary, to control the other rotor 20*b* only while the corresponding annular groove segments are aligned. The two rotors 20*a*, 20*b* can be mounted on different shafts or can be mounted on the same shaft 12. More than two rotors 20, 20*a*, 20*b* could share oil feeds and/or control valves 60, by splitting the annular groove into more segments. A shared oil feed groove with one control valve 60 can provide phaser control by moving the control valve 60 away from the null position while groove segments align with advance-timing expandable fluid chambers 40, 40*a*, 40*b* and retard-timing expandable fluid chambers 50, 50*a*, 50*b* and move back to the null position to close off flow until that alignment repeats, then move the control valve 60 away from the null position to continue phaser motion. Alternatively, the control valve 60 can oscillate in both directions from the null position during a single revolution of the camshaft. The control valve 60 can be oscillated at a cam rotation frequency, or at fractional multiples of cam rotation frequency. Advance and retard the timing of the control valve 60 motion to overlap more or less with the portion of the cam rotation where the groove segments allow oil flow in or out of the phaser. In other words, the control valve 60 is not held in the null position; instead flow from the control valve 60 to the phaser is opened or closed by varying the overlap of the valve opening and the groove segment openings.

Figure 9:
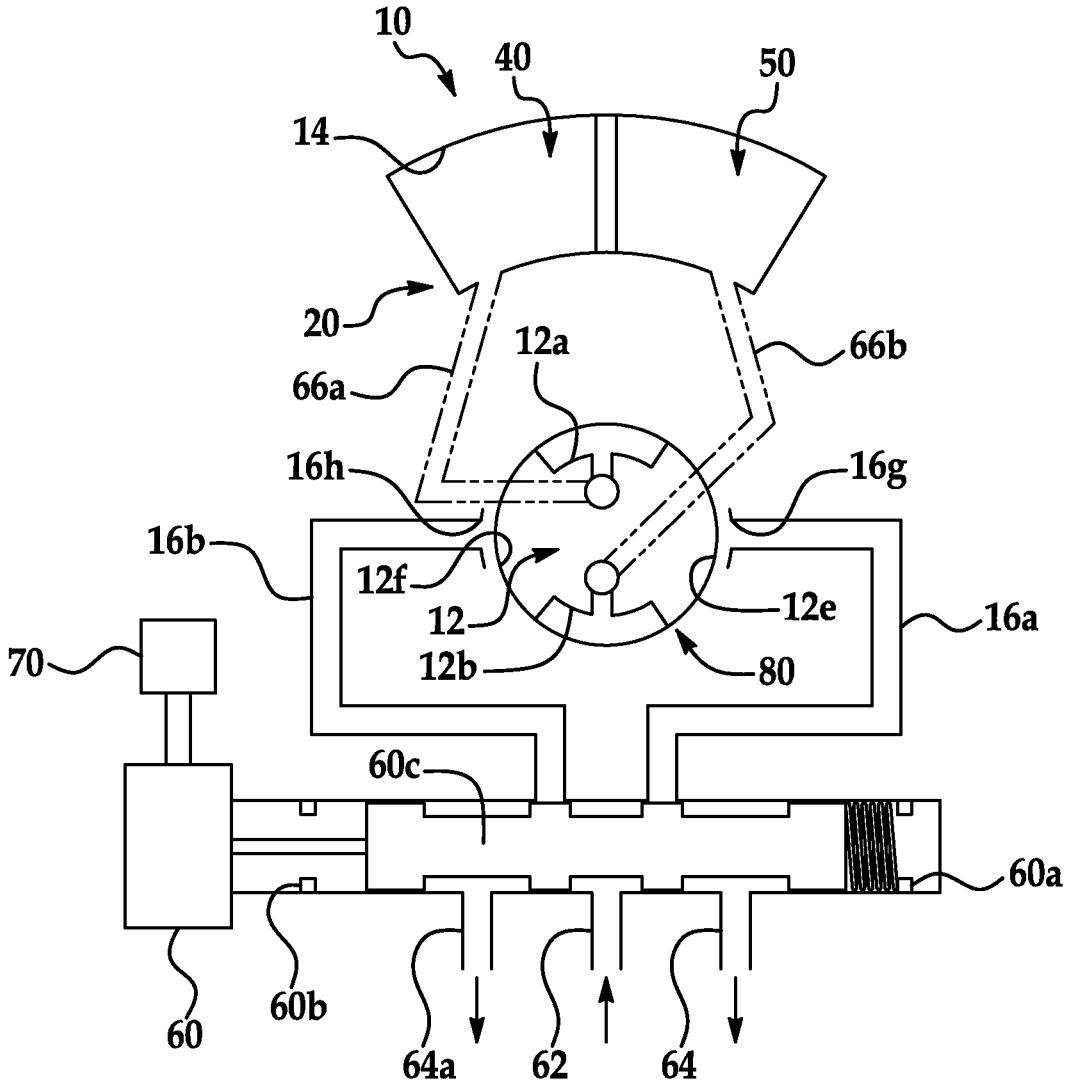
FIG. 9 is a simplified schematic of a pressurized fluid control system illustrating two circumferentially spaced annular groove segments on a rotatable fluid flow diverter defining four zones of operation.

Referring now to FIG. 9, by way of example and not limitation, a variable cam timing phaser 10 is similar to that shown and described with respect to FIG. 1-3, where the at least one common shared fluid passage 16 can include first and second common shared fluid passages 16*a*, 16*b* in fluid communication with the first and second expandable fluid chambers 40, 50 through corresponding first and second fluid passages 66*a*, 66*b*, and the control valve 60 can include an inlet port 62 and outlet ports 64, 64*a*. The control valve 60 is shown in a null position preventing fluid communication from the inlet port 62 or the outlet ports 64, 64*a* with either of the first and second expandable fluid chambers 40, 50. By way of example and not limitation, the first expandable fluid chamber 40 can correspond to an advancing chamber, and the second expandable fluid chamber 50 can correspond to a retarding chamber. A first zone (Zone 1) of operation is defined when the first groove segment 12*a* aligns in fluid communication with a port 16*g* of the first common shared fluid passage 16*a* and the second groove segment 12*b* aligns in fluid communication with a port 16*h* of the second common shared fluid passage 16*b*. A second zone (Zone 2) of operation is defined when the first groove segment 12*a* aligns in fluid communication with the port 16*h* of the second common shared fluid passage 16*b* and the second groove segment 16*b* aligns in fluid communication with the first common shared fluid passage 16*a*. By of example and not limitation, the diverter valve 80 located on the shaft 12 is illustrated rotating in a clockwise direction. The control valve 60 includes a full travel limit position 60*a* located to the right of the spool as illustrated, and a zero travel limit position 60*b* located to the left of the spool as illustrated.

Figure 10A:
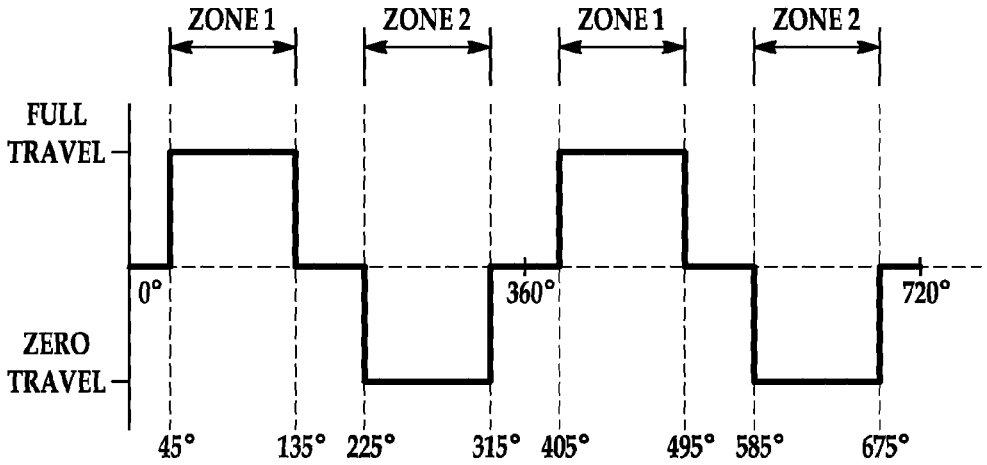
FIG. 10A is a graph illustrating a maximum rate of phaser advancing movement for the pressurized fluid control system illustrated in FIG. 9, where the vertical axis shows control valve position from zero travel to full travel and the horizontal axis shows rotational position of the fluid flow diverter from 0° to 720° of rotation.

Referring now to FIGS. 10A-10F, the operation of the phaser control system is described with respect to a position of the spool of the control valve between full travel position 60*a* and zero travel position 60*b* shown on the Y axis versus camshaft rotational position (in degrees) shown along the X axis. Referring first to FIG. 10A, the camshaft 12 and associated diverter valve 80 are shown in a 0° rotational position as illustrated in FIG. 9, where fluid communication is prevented by lands 12*e* and 12*f* of the diverter valve 80 blocking ports 16*g*, 16*h* respectively, and the control valve 60 has the spool located in the null position. As the camshaft 12 and associated diverter valve 80 rotate clockwise approximately 45° from the position shown in FIG. 9, the control valve 60 drives the spool in a right hand direction as illustrated in FIG. 9 to the full travel position 60*a*, allowing fluid communication between the inlet port 62 and the first expandable fluid chamber 40 through first common shared fluid passage 16*a*, groove segment 12*a*, and first fluid passage 66*a* expanding the advancing chamber 40 and between the outlet port 64*a* and the second expandable fluid chamber 50 through second common shared fluid passage 16*b*, groove segment 12*b*, and second fluid passage 66*b* contracting the retarding chamber 50 allowing the phaser 10 to advance at a maximum rate. As the camshaft 12 and associated diverter valve 80 continue to rotate through approximately 90° (a total of 135° from the position illustrated in FIG. 9), fluid communication is prevented by lands 12*e* and 12*f* of the diverter valve 80 blocking ports 16*h*, 16*g* respectively, and the control valve 60 returns the spool to the null position. As the camshaft 12 and associated diverter valve 80 continue to rotate through approximately 90° (a total of 225° from the position illustrated in FIG. 9), the control valve 60 shifts the spool in a left hand direction as illustrated in FIG. 9 to the zero travel position 60*b*, allowing fluid communication between the inlet port 62 and the first expandable fluid chamber 40 through second common shared fluid passage 16*b*, groove segment 12*a*, and first fluid passage 66*a* expanding the advancing chamber 40 and between the outlet port 64 and the second expandable fluid chamber 50 through first common shared fluid passage 16*a*, groove segment 12*b*, and second fluid passage 66*b* contracting the retarding chamber 50 allowing the phaser 10 to continue advancing movement at a maximum rate. As the camshaft 12 and associated diverter valve 80 continue to rotate through approximately 90° (a total of 315° from the position illustrated in FIG. 9), fluid communication is prevented by lands 12*e* and 12*f* of the diverter valve 80 blocking ports 16*g*, 16*h* respectively, and the control valve 60 returns the spool to the null position. The control sequence repeats during times when the control valve 60 is attempting to provide phaser advancing movement at a maximum rate.

Figure 10B:
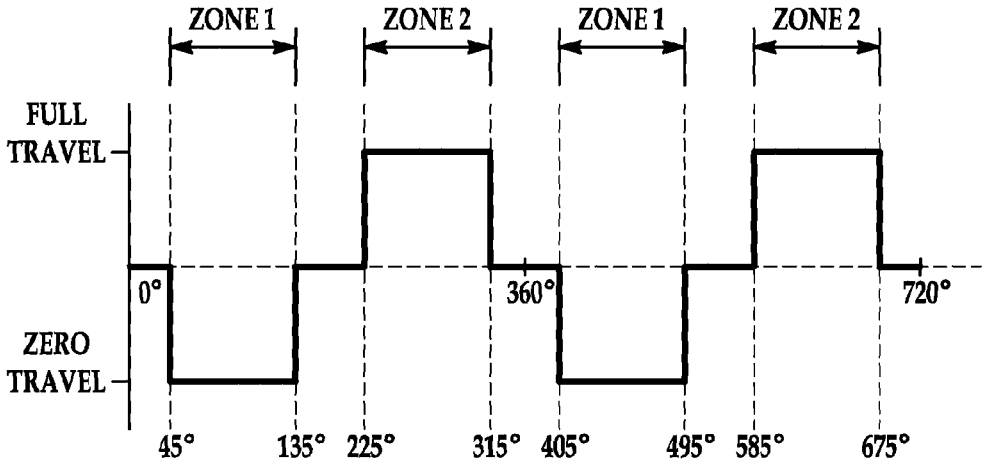
FIG. 10B is a graph illustrating a maximum rate of phaser retarding movement for the pressurized fluid control system illustrated in FIG. 9, where the vertical axis shows control valve position from zero travel to full travel and the horizontal axis shows rotational position of the fluid flow diverter from 0° to 720° of rotation.

Referring now to FIG. 10B, the camshaft 12 and associated diverter valve 80 are shown in a 0° rotational position as illustrated in FIG. 9, where fluid communication is prevented by lands 12*e* and 12*f* of the diverter valve 80 blocking ports 16*g*, 16*h* respectively, and the control valve 60 has the spool located in the null position. As the camshaft 12 and associated diverter valve 80 rotate clockwise approximately 45° from the position shown in FIG. 9, the control valve 60 drives the spool in a left hand direction as illustrated in FIG. 9 to the zero travel position 60*b*, allowing fluid communication between the inlet port 62 and the second expandable fluid chamber 50 through second common shared fluid passage 16*b*, groove segment 12*b*, and second fluid passage 66*b* expanding the retarding chamber 50 and between the outlet port 64 and the first expandable fluid chamber 40 through first common shared fluid passage 16*a*, groove segment 12*a*, and first fluid passage 66*a* contracting the advancing chamber 40 allowing the phaser 10 to retard at a maximum rate. As the camshaft 12 and associated diverter valve 80 continue to rotate through approximately 90° (a total of 135° from the position illustrated in FIG. 9), fluid communication is prevented by lands 12*e* and 12*f* of the diverter valve 80 blocking ports 16*h*, 16*g* respectively, and the control valve 60 returns the spool to the null position. As the camshaft 12 and associated diverter valve 80 continue to rotate through approximately 90° (a total of 225° from the position illustrated in FIG. 9), the control valve 60 shifts the spool in a right hand direction as illustrated in FIG. 9 to the full travel position 60*a*, allowing fluid communication between the inlet port 62 and the second expandable fluid chamber 50 through first common shared fluid passage 16*a*, groove segment 12*b*, and second fluid passage 66*b* expanding the retarding chamber 50 and between the outlet port 64*a* and the first expandable fluid chamber 40 through second common shared fluid passage 16*b*, groove segment 12*a*, and first fluid passage 66*a* contracting the advancing chamber 40 allowing the phaser 10 to continue retarding movement at a maximum rate. As the camshaft 12 and associated diverter valve 80 continue to rotate through approximately 90° (a total of 315° from the position illustrated in FIG. 9), fluid communication is prevented by lands 12*e* and 12*f* of the diverter valve 80 blocking ports 16*g*, 16*h* respectively, and the control valve 60 returns the spool to the null position. The control sequence repeats during times when the control valve 60 is attempting to provide phaser retarding movement at a maximum rate.

Figure 10C:
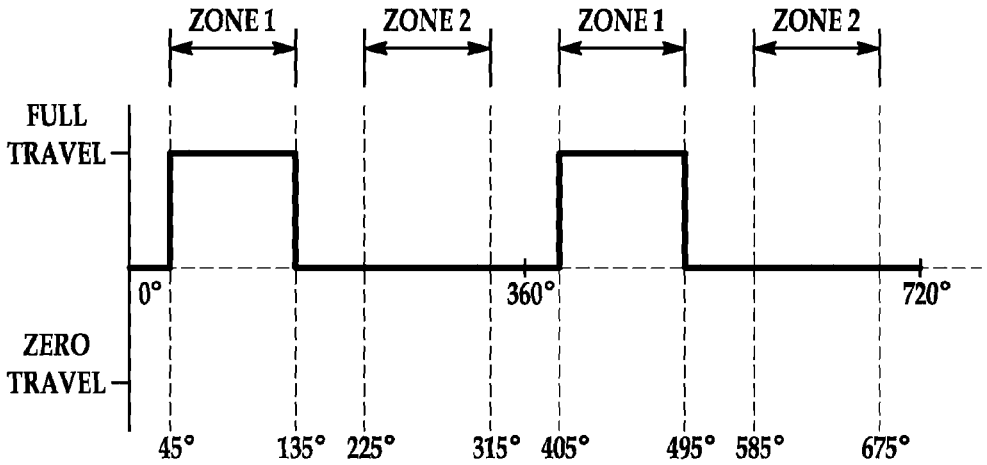
FIG. 10C is a graph illustrating a intermediate rate of phaser advancing movement for the pressurized fluid control system illustrated in FIG. 9, where the vertical axis shows control valve position from zero travel to full travel and the horizontal axis shows rotational position of the fluid flow diverter from 0° to 720° of rotation

Referring now to FIG. 10C, the phaser 10 can be advanced (as illustrated), or retarded (not shown; i.e. opposite spool movement from that illustrated), at an intermediate rate by pulsing an inlet fluid connection and outlet fluid connection with the advancing chamber 40 and the retarding chamber 50 during either Zone 1 or Zone 2 alignment, or at any multiple of cam rotation frequency to achieve the desired rate of movement. It should be recognized that the smaller the ratio of open fluid communication to camshaft rotation used for driving the control valve 60, the slower the rate of movement of the phaser (i.e. less fluid communication time between the first and second chambers 40, 50 and the inlet and outlet ports 62, 64 or 64*a* while operating in either an advancing or retarding movement mode of operation). For example, a maximum rate of movement corresponds to open fluid communication between inlet port 60/outlet ports 64 or 64*a* and the first and second expandable fluid chambers 40, 50 twice every 360° of rotation as illustrated in FIGS. 9 and 10A-10B providing an open fluid connection to camshaft rotation ratio of 2:1. As illustrated in FIG. 10C, the rate of advancing movement could be half the maximum rate by providing open fluid communication only once every 360° of camshaft rotation (providing an open fluid communication to camshaft rotation ratio of 1:1). It should be recognized that the rate of retarding movement could likewise be half of the maximum rate by providing open fluid communication only once every 360° of cam shaft rotation providing an open fluid communication to camshaft rotation ratio of 1:1. It should further be recognized that the ratio of open fluid connection to each full 360° rotation could be other fractions, by way of example and not limitation such as two open fluid communications for every three rotations of the camshaft providing a ratio of 2:3. The control valve 60 can be controlled by the engine control unit 70 to switch between advancing movement and retarding movement of the phaser depending on engine operating conditions being monitored by the engine control unit 70.

Figure 10D:
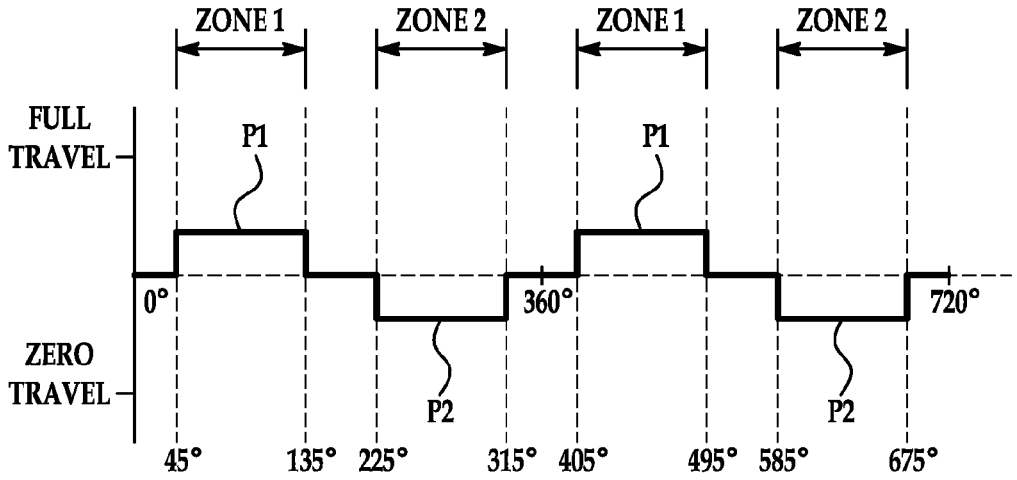
FIG. 10D is a graph illustrating a variable rate of phaser advancing movement for the pressurized fluid control system illustrated in FIG. 9 by modulating valve travel, where the vertical axis shows control valve position from zero travel to full travel and the horizontal axis shows rotational position of the fluid flow diverter from 0° to 720° of rotation.

Referring now to FIG. 10D, the rate of phaser 10 movement, either in an advancing direction (as illustrated) or in a retarding direction (not shown; i.e. opposite spool movement from that illustrated), can be controlled by modulating the distance of spool travel between a position P1 less than a distance between null position of the spool and the full travel position 60*a* of the spool, and a position P2 less than a distance between the null position of the spool and the zero travel position 60*b* of the spool. The reduced movement of the spool provides a partially open fluid passage between the inlet port 62/outlet port 64 or 64*a* and the corresponding first and second expandable fluid chambers 40, 50 to be controlled, effectively limiting the rate of movement in the advancing or retarding directions depending on the mode of operation called for by the engine control unit 70. It should be recognized that the modulating valve travel mode of control illustrated in FIG. 10C can be used individually, or can be used in combination with the intermediate rate of valve travel illustrated in FIG. 10B to provide a greater range of control over the rate of movement of the phaser 10 between advanced and retarded positions.

Figure 10E:
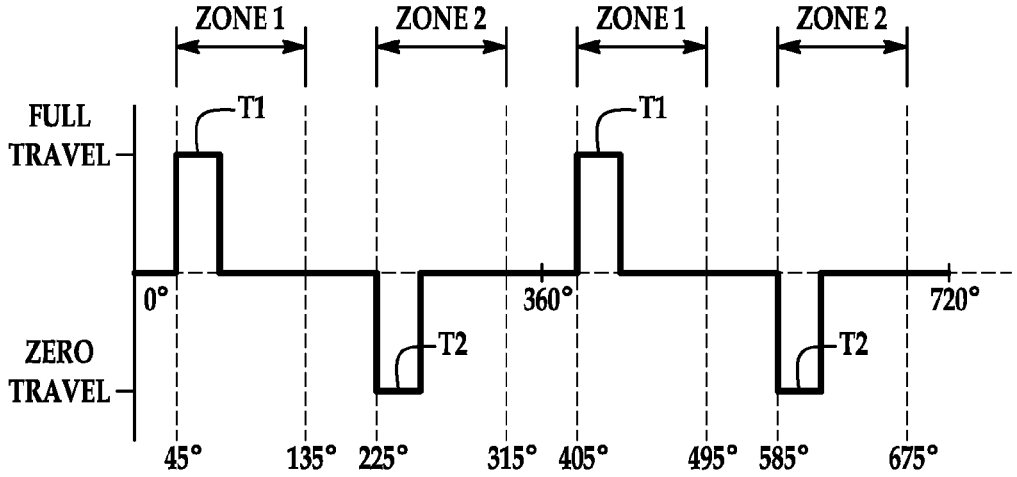
FIG. 10E is a graph illustrating a variable rate of phaser advancing movement for the pressurized fluid control system illustrated in FIG. 9 by modulating control valve open dwell time, where the vertical axis shows control valve position from zero travel to full travel and the horizontal axis shows rotational position of the fluid flow diverter from 0° to 720° of rotation.

Referring now to FIG. 10E, the rate of phaser 10 movement, either in an advancing direction (as illustrated) or in a retarding direction (now shown; i.e. opposite spool movement from that illustrated), can be controlled by modulating a valve open dwell time period. By way of example and not limitation, the spool can be driven by the control valve 60 to the full travel position 60*a* or the zero travel position 60*b*, in Zone 1 or Zone 2, depending on whether advancing or retarding movement is called for by the engine control unit 70, for a period of time (dwell time) T1, T2 less than the period of time that the groove segments 12*a*, 12*b* are aligned in fluid communication with the corresponding port 16*g*, 16*h* of the first and second common shared fluid passages 16*a*, 16*b*. The smaller the spool valve open dwell time, the slower the rate of movement of the phaser 10 between the advanced and retarded positions. In other words, the spool valve can be driven to the full travel position 60*a* or the zero travel position 60*b*, in a fractional portion of Zone 1 or a fractional portion of Zone 2, depending on whether advancing or retarding movement is called for by the engine control unit 70. The fractional portion of open fluid communication in Zone 1, or fractional portion of open fluid communication in Zone 2, correspond to a portion of the angular rotational alignment between the groove segments 12*a*, 12*b* and the corresponding ports 16*g*, 16*h* of the first and second common shared fluid passages 16*a*, 16*b*. In the illustrated case of FIG. 10E, open fluid flow communication is allowed between the inlet port 62/outlet ports 64 or 64*a* and the first and second expandable fluid chambers 40, 50 for a portion of the alignment between the groove segments 12*a*, 12*b* and the ports 16*g*, 16*h* occurring between 45° and 135° of camshaft rotation, and for a portion of the alignment between the groove segments 12*a*, 12*b* and the ports 16*g*, 16*h* occurring between 225° and 315° of camshaft rotation. The fractional portion can be varied between 0% and 100% of the angular rotational alignment between the groove segments 12*a*, 12*b* and the corresponding ports 16*g*, 16*h* of the first and second common shared fluid passages 16*a*, 16*b* depending on the rate of movement between advancing and retarding positions desired. A smaller fractional portion will correspond to a slower rate of movement between the advancing and retarding positions. It should be recognized that the fractional portion of open fluid communication does not have to begin at a beginning of Zone 1 or Zone 2, or end at an ending of Zone 1 or Zone 2, and can fall anywhere within the angular rotational alignment between grooves 12*a*, 12*b* and the corresponding ports 16*g*, 16*h* of the first and second common shared fluid passages 16*a*, 16*b*. It should be recognized that the modulating valve open dwell control illustrated in FIG. 10E can be used individually, or can be used in combination with the modulated valve travel control illustrated in FIG. 10D, or can be used in combination with the intermediate rate control illustrated in FIG. 10C, or can be used in combination with the modulated valve travel control illustrated in FIG. 10D and the intermediate rate control illustrated in FIG. 10C to provide a greater range of control over the rate of movement of the phaser 10 between advanced and retarded positions.

Figure 10F:
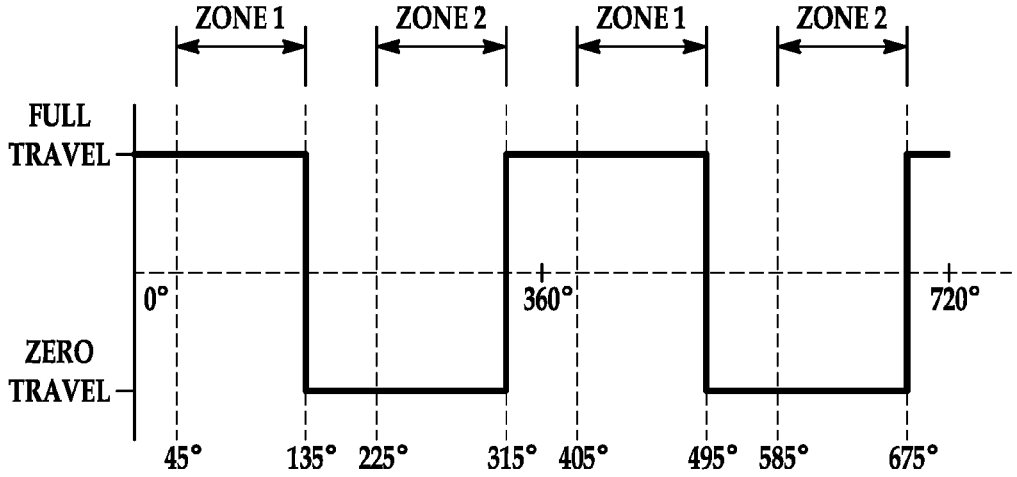
FIG. 10F is a graph illustrating a phaser advancing movement for the pressurized fluid control system illustrated in FIG. 9 without any null position dwell time, where the vertical axis shows control valve position from zero travel to full travel and the horizontal axis shows rotational position of the fluid flow diverter from 0° to 720° of rotation.

Referring now to FIG. 10F, the rate of phaser 10 movement, either in an advancing direction (as illustrated) or in a retarding direction (now shown; i.e. opposite spool movement from that illustrated), can be provided by an on/off control valve 60 driving the spool between the full travel position 60*a* and the zero travel position 60*b* without any dwell at a null position interposed between the two end limits of spool travel. In this control system, the phaser 10 is either being driven in the advancing direction (as illustrated) or in the retarding direction (not shown; i.e. opposite spool movement from that illustrated) during phaser 10 adjustment.

When a desired phaser angular position is reached with an on/off control valve 60, the phaser 10 can be maintained in position by either leaving the spool at the full travel position 60*a*, or by leaving the spool at the zero travel position 60*b*, across both Zone 1 and Zone 2, thereby allowing the phaser to oscillate around the desired angular position. However, this control method can produce greater variance from the desired angular position of the phaser 10 than is acceptable for a particular application depending on other operating characteristics of the fluid flow system. If a greater degree of control is desired, or a lesser degree of variance from the desired angular position is desired, the on/off control valve 60 can be modulated similar to FIG. 10E (excluding the null dwell position of FIG. 10E) to drive the spool between the full travel position 60*a* and the zero travel position 60*b* multiple times within both Zone 1 and Zone 2 to maintain the phaser in closer proximity to the desired angular position until further advancing or retarding movement is required by the engine control unit 70. Alternatively, the engine control unit 70 can shift the operation of the on/off control valve 60 between advancing movement and retarding movement based on a predetermined value of variance between a sensed actual phaser position and a desired phaser position. The predetermined value of variance can be either calculated by the engine control unit 70, or can be stored in a value of variance lookup table correlated to other engine operating characteristics being sensed and monitored by the engine control unit 70.

It should be recognized with respect to FIGS. 10A-10F that the illustrated and described angular positions are for illustrative purposes only, and that other alternative angular positions can be selected depending on the desired operating characteristics of the particular application. The invention is illustrated and described, by way of example and not limitation, with respect to 90° annular groove segments and 90° angular offsets between the angular groove segments. However, it should be recognized that the annular groove segments can be smaller or larger than that illustrated and described. Furthermore, the angular offsets between annular groove segments can be smaller or larger than that illustrated and described. In addition, the number of annular groove segments and corresponding lands can be more or less than that illustrated and described. Any of these modifications, taken singularly or in any permissible combinations, is within the scope of the disclosed invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A variable cam timing phaser (10) comprising:

a drive stator (14) and at least one driven rotor (20, 20*a*, 20*b*) all mounted for rotation about a common axis, wherein the at least one driven rotor (20*a*, 20*b*) further comprises first and second driven rotors (20*a*, 20*b*);

at least one vane-type hydraulic coupling defining at least one expandable fluid chamber (40, 50, 40*a*, 50*a*, 40*b*, 50*b*) for coupling the at least one driven rotor (20, 20*a*, 20*b*) for rotation with the drive stator (14) to enable the phase of the at least one driven rotor (20, 20*a*, 20*b*) to be adjusted independently relative to the drive stator (14), wherein the at least one vane-type hydraulic coupling defines a plurality of expandable fluid chambers (40, 50, 40*a*, 50*a*, 40*b*, 50*b*) for coupling the first and second driven rotors (20*a*, 20*b*) for rotation with the drive stator (14) to enable the phase of the first and second driven rotors (20*a*, 20*b*) to be adjusted independently relative to each other and relative to the drive stator (14);

a control valve (60) having at least one inlet port (62), at least one outlet port (64, 64*a*), and at least one common shared fluid passage (16, 16*a*, 16*b*, 16*c*, 16*d*) for both oil supply and oil drain fluid communication with the at least one expandable fluid chamber (40, 50, 40*a*, 50*a*, 40*b*, 50*b*); and at least one rotatable fluid flow diverter (80, 80*a*) in fluid communication with the at least one common shared fluid passage (16, 16*a*, 16*b*, 16*c*, 16*d*) for selectively communicating the at least one common shared fluid passage (16, 16*a*, 16*b*, 16*c*, 16*d*) with the at least one expandable fluid chamber (40, 50, 40*a*, 50*a*, 40*b*, 50*b*).

2. The phaser of claim 1, wherein the at least one fluid flow diverter (80, 80*a*) further comprises:

at least one annular groove segment (12*a*, 12*b*, 12*c*, 12*d*) extending around a portion of a circumference of one of at least one shaft (12) and at least one bearing (98), while an other of the at least one bearing and at least one shaft includes a fluid communication port (12*p*), a corresponding one of the at least one expandable fluid chambers (40, 50, 40*a*, 50*a*, 40*b*, 50*b*) in fluid communication through a fluid flow connection established between the at least one annular groove segment and the at least one fluid communication port, rotation of the at least one shaft (12) bringing the at least one annular groove segment and the at least one fluid communication port into fluid communication with one another during a repetitive angular part of the rotation of the at least one shaft (12) for selectively communicating the at least one common shared fluid passage (16, 16*a*, 16*b*, 16*c*, 16*d*) with the corresponding one of the at least one expandable fluid chamber (40, 50, 40*a*, 50*a*, 40*b*, 50*b*).

3. The phaser of claim 1, wherein the at least one expandable fluid chamber (40, 50, 40*a*, 50*a*, 40*b*, 50*b*) further comprises an advance-timing expandable fluid chamber (40, 40*a*, 40*b*) and a retard-timing expandable fluid chamber (50, 50*a*, 50*b*).

4. The phaser of claim 3, wherein the at least one fluid flow diverter (80, 80*a*) further comprises at least one shaft (12) having at least two annular groove segments (12*a*, 12*b*, 12*c*, 12*d*) extending around a portion of a circumference of one of the at least one shaft (12) and at least one bearing (98), each annular groove segment (12*a*, 12*b*, 12*c*, 12*d*) individually in fluid communication with the at least one common shared fluid passage (16*a*, 16*b*, 16*c*, 16*d*) during an angular part of the rotation of the at least one shaft (12) for selectively communicating the common shared fluid passage (16*a*, 16*b*, 16*c*, 16*d*) with the advance-timing expandable fluid chamber (40, 40*a*, 40*b*) and the retard-timing expandable fluid chamber (50, 50*a*, 50*b*).

5. The phaser of claim 4, wherein the at least one common shared passage (16, 16*a*, 16*b*, 16*c*, 16*d*) further comprises at least two common shared fluid passages (16*a*, 16*b*, 16*c*, 16*d*), wherein each common shared fluid passage (16*a*, 16*b*, 16*c*, 16*d*) individually aligns for fluid communication through a corresponding aligned annular groove segment (12*a*, 12*b*, 12*c*, 12*d*) during an angular part of the rotation of the at least one shaft (12) for selectively communicating the aligned common shared fluid passage (16*a*, 16*b*, 16*c*, 16*d*) with the advance-timing expandable fluid chamber (40, 40*a*, 40*b*) and the retard-timing expandable fluid chamber (50, 50*a*, 50*b*).

6. The phaser of claim 4, wherein the at least one common shared passage (16, 16*a*, 16*b*, 16*c*, 16*d*) further comprises at least two common shared passages (16*a*, 16*b*, 16*c*, 16*d*), and the at least two annular groove segments (12*a*, 12*b*, 12*c*, 12*d*) further comprises at least four groove segments (12*a*, 12*b*, 12*c*, 12*d*) extending around a portion of at least one circumference of one of at least one shaft (12) and at least one bearing, each annular groove segment (12*a*, 12*b*, 12*c*, 12*d*) individually in fluid communication with an aligned common shared fluid passage (16*a*, 16*b*, 16*c*, 16*d*) during an angular part of the rotation of the at least one shaft (12) for selectively communicating the aligned common shared fluid passage (16*a*, 16*b*, 16*c*, 16*d*) with the advance-timing expandable fluid chamber (40, 40*a*, 40*b*) and the retard-timing expandable fluid chamber (50, 50*a*, 50*b*).

7. The phaser of claim 6, wherein the at least four annular groove segments (12*a*, 12*b*, 12*c*, 12*d*) are located in a single transverse circumferential plane with respect to one of the at least one shaft (12) and the at least one bearing.

8. The phaser of claim 6, wherein the at least four annular groove segments (16*a*, 16*b*, 16*c*, 16*d*) are divided into two groups of segments located in two separate transverse circumferential planes with respect to one of the at least one shaft (12) and the at least one bearing.

9. The phaser of claim 1, wherein the drive stator further comprises:

a first drive stator (14) and at least one driven rotor (20, 20*a*, 20*b*) all mounted for rotation about a common first axis of a first shaft (12);

a second drive stator (14*a*) and at least one driven rotor (20, 20*a*, 20*b*) all mounted for rotation about a common second axis of a second shaft (12);

wherein the at least one vane-type hydraulic coupling further comprises:

at least one expandable fluid chamber (40, 50, 40*a*, 50*a*, 40*b*, 50*b*) for coupling each of the at least one driven rotor (20, 20*a*, 20*b*) for rotation with the corresponding first and second drive stator (14, 14*a*) to enable the phase of each of the at least one driven rotor (20, 20*a*, 20*b*) to be adjusted independently relative to the corresponding first and second drive stator (14, 14*a*); and wherein the control valve (60) further comprises:

a single control valve (60) in fluid communication with the at least one rotatable fluid flow diverter (80, 80*a*) for selectively communicating the at least one common shared fluid passage (16, 16*a*, 16*b*, 16*c*, 16*d*) with the at least one expandable fluid chamber (40, 50, 40*a*, 50*a*, 40*b*, 50*b*).

10. A pressurized fluid control system comprising:

at least two members (14, 20, 20*a*, 92) defining at least one expandable fluid chamber (40, 50, 90) therebetween and movable with respect to one another in response to fluid flow into and out of the at least one expandable fluid chamber (40, 50, 90);

a control valve (60) having at least one inlet port (62), at least one outlet port (64, 64*a*), and at least one common shared fluid passage (16, 16*a*, 16*b*, 16*c*, 16*d*) for both oil supply and oil drain fluid communication with the at least one expandable fluid chamber (40, 50, 90); and at least one rotatable fluid flow diverter (80, 80*a*) in fluid communication with the at least one common shared fluid passage (16, 16*a*, 16*b*, 16*c*, 16*d*) for selectively communicating the at least one common shared fluid passage (16, 16*a*, 16*b*, 16*c*, 16*d*) with the at least one expandable fluid chamber (40, 50, 40*a*, 50*a*, 40*b*, 50*b*, 90), the at least one rotatable fluid flow diverter having at least one annular groove segment (12*a*, 12*b*, 12*c*, 12*d*) extending around a portion of at least one circumference of one of at least one shaft (12) and at least one bearing (98), while another of the at least one bearing and the at least one shaft includes a fluid communication port (12*p*), a corresponding one of the at least one expandable fluid chamber (40, 50, 90) in fluid flow communication through a fluid flow connection established between the at least one annular groove segment (12*a*, 12*b*, 12*c*, 12*d*) and the at least one fluid communication port for selectively communicating the at least one common shared fluid passage (16, 16*a*, 16*b*, 16*c*, 16*d*) with the at least one expandable fluid chamber (40, 50, 90) during a repetitive angular part of each rotation as the shaft rotates; and wherein the at least two members include a locking pin (92) movable with respect to a stator (14) and at least one rotor (20, 20*a*) in response to pressurized fluid introduced into the at least one expandable fluid chamber (90) for unlocking the angular position of the stator (14) and at least one rotor (20, 20*a*) with respect to one another.

11. A method for controlling a pressurized fluid control system having at least two members (14, 20, 20*a*, 92) defining at least one expandable fluid chamber (40, 50, 40*a*, 50*a*, 40*b*, 50*b*, 90) therebetween and movable with respect to one another in response to fluid flow into and out of the at least one expandable fluid chamber (40, 50, 90) comprising:

driving a spool (60*c*) of a control valve (60) between at least two positions selected from positions located between a full travel position (60*a*) and a zero travel position (60*b*), the control valve (60) having at least one inlet port (62), at least one outlet port (64, 64*a*), and at least one common shared fluid passage (16, 16*a*, 16*b*, 16*c*, 16*d*) for both oil supply and oil drain fluid communication with the at least one expandable fluid chamber (40, 50, 90);

rotating at least one rotatable fluid flow diverter (80, 80*a*) having at least one annular groove segment (12*a*, 12*b*, 12*c*, 12*d*) extending around a portion of at least one circumference of one of at least one shaft (12) and at least one bearing (98), while an other of the at least one bearing and at least one shaft includes a fluid communication port (12*p*), a corresponding one of the at least one expandable fluid chamber (40, 50, 40*a*, 50*a*, 40*b*, 50*b*) in fluid communication through a fluid flow connection between the at least one annular groove segment (12*a*, 12*b*, 12*c*, 12*d*) and the at least one fluid communication port, wherein rotating the shaft (12) brings the at least one annular groove segment (12*a*, 12*b*, 12*c*, 12*d*) and at least one fluid communication port into fluid communication with one another for selectively communicating the at least one common shared fluid passage (16, 16*a*, 16*b*, 16*c*, 16*d*) with the at least one expandable fluid chamber (40, 50, 40*a*, 50*a*, 40*b*, 50*b*, 90) during a repetitive angular portion of each rotation; and adjusting a phase angle of a phaser (10) in response to a position of the spool (60*c*) and rotation of the rotatable fluid flow diverter, the phaser (10) having a drive stator (14) and at least one driven rotor (20, 20*a*, 20*b*) all mounted for rotation about a common axis, wherein at least one vane-type hydraulic coupling defines at least one expandable fluid chamber (40, 50, 40*a*, 50*a*, 40*b*, 50*b*) for coupling the at least one driven rotor (20, 20*a*, 20*b*) for rotation with the drive stator (14) to enable the phase of the at least one driven rotor (20, 20*a*, 20*b*) to be adjusted independently relative to the drive stator (14).

12. The method of claim 11 further comprising:

driving the spool (60*c*) of the control valve (60) to a central null position located between the full travel position (60*a*) and the zero travel position (60*b*); and holding the spool (60*c*) of the control valve (60) in the central null position to prevent fluid communication between the at least one inlet port (62), the at least one outlet port (64, 64*a*), and the at least one common shared fluid passage (16, 16*a*, 16*b*, 16*c*, 16*d*).

13. The method of claim 11 further comprising:

controlling a rate of phaser movement by modulating at least one of:

a duration time of fluid communication with the at least one expandable fluid chamber to be controlled;

a travel distance of the spool (60*c*) from a null position to a driven position located between a zero travel position and a full travel position of the spool (60*c*) to provide a partially open fluid passage in fluid communication with the at least one expandable fluid chamber to be controlled;

a valve open dwell time period of the spool (60*c*) to provide a reduced valve open time period when in fluid communication with the at least one expandable fluid chamber to be controlled; and a rate of oscillation of the spool (60*c*) between a full travel position and a zero travel position without dwell at a null position interposed between end limits of travel of the spool (60*c*).

* * * * *